US011898558B2

(12) United States Patent
Lee et al.

(10) Patent No.: US 11,898,558 B2
(45) Date of Patent: Feb. 13, 2024

(54) SCROLL COMPRESSOR

(71) Applicant: Hanon Systems, Daejeon (KR)

(72) Inventors: Kyung Jae Lee, Daejeon (KR); Jeoong Ki Seo, Daejeon (KR); Jong Hyun Jeon, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 17/646,356

(22) Filed: Dec. 29, 2021

(65) Prior Publication Data

US 2022/0268282 A1 Aug. 25, 2022

(30) Foreign Application Priority Data

Feb. 19, 2021 (KR) ..... 10-2021-0022683
Dec. 10, 2021 (KR) ..... 10-2021-0176917

(51) Int. Cl.
*F04C 18/02* (2006.01)
*F04C 29/02* (2006.01)
(Continued)

(52) U.S. Cl.
CPC ..... *F04C 18/0215* (2013.01); *F04C 18/0261* (2013.01); *F04C 23/008* (2013.01);
(Continued)

(58) Field of Classification Search
CPC .. F04C 29/023; F04C 18/0215; F04C 23/008; F04C 29/0085; F04C 29/028; F04C 18/0261; F04C 29/12
(Continued)

(56) References Cited

U.S. PATENT DOCUMENTS

2006/0159580 A1* 7/2006 Matsuhashi ..... B23D 5/02 418/55.1

FOREIGN PATENT DOCUMENTS

EP 0980978 A1 * 2/2000 ..... F04C 18/02
JP H11315792 A * 11/1999 ..... F04C 18/02
(Continued)

OTHER PUBLICATIONS

JP-2016142258-A, English Language Machine Translation (Year: 2016).*
(Continued)

*Primary Examiner* — Wesley G Harris
(74) *Attorney, Agent, or Firm* — Shumaker, Loop & Kendrick, LLP; James D. Miller

(57) ABSTRACT

A scroll compressor including: a housing; a motor provided in the housing; a rotary shaft configured to be rotated by the motor; an orbiting scroll configured to orbit in conjunction with the rotary shaft; and a fixed scroll configured to define compression chambers together with the orbiting scroll, in which the housing includes: a center housing penetrated by the rotary shaft; a front housing configured to define a motor accommodation space that accommodates the motor; and a rear housing configured to define a discharge chamber for accommodating a refrigerant discharged from the compression chambers, and an introduction chamber for accommodating a middle-pressure refrigerant introduced from the outside of the housing, in which the fixed scroll has a plurality of injection ports that guides the refrigerant in the introduction chamber to the compression chambers.

14 Claims, 22 Drawing Sheets

(51) Int. Cl.
*F04C 29/00* (2006.01)
*F04C 23/00* (2006.01)

(52) U.S. Cl.
CPC ..... *F04C 29/0007* (2013.01); *F04C 29/0085* (2013.01); *F04C 29/023* (2013.01); *F04C 29/028* (2013.01)

(58) Field of Classification Search
USPC ..... 418/55.1; 417/410.5
See application file for complete search history.

(56) References Cited

FOREIGN PATENT DOCUMENTS

| | | | | | |
|---|---|---|---|---|---|
| JP | 2015129476 | A | * | 7/2015 | |
| JP | 2015129476 | A | | 7/2015 | |
| JP | 2016142258 | A | * | 8/2016 | ..... F04C 18/0215 |
| KR | 101382007 | B1 | * | 4/2014 | ..... F04C 18/0215 |
| KR | 20210012291 | A | | 2/2021 | |
| WO | WO-2014156743 | A1 | * | 10/2014 | ..... F04C 18/0215 |
| WO | 2021015439 | A1 | | 1/2021 | |

OTHER PUBLICATIONS

WO-2014156743-A1, English Language Machine Translation (Year: 2014).*
JP-2015129476-A, English Language Machine Translation (Year: 2015).*

* cited by examiner

SCROLL COMPRESSOR

CROSS-REFERENCE TO RELATED PATENT APPLICATIONS

This patent application claims priority to Korean Patent Application No. KR 10 2021 0022683 filed on Feb. 19, 2021 and Korean Patent Application No. KR 10 2021 0176917 filed on Dec. 10, 2021, the entire disclosures of each of which is hereby incorporated herein by reference.

TECHNICAL FIELD

The present disclosure relates to a scroll compressor, and more particularly, to a scroll compressor capable of compressing a refrigerant using a fixed scroll and an orbiting scroll.

BACKGROUND ART

In general, an air conditioning (A/C) device is installed in a vehicle to cool or heat the interior of the vehicle. The air conditioning device includes a compressor which is a component of a cooling system, and the compressor compresses a low-temperature and low-pressure gaseous refrigerant introduced from an evaporator to make a high-temperature and high-pressure gaseous refrigerant and delivers the refrigerant to a condenser.

The compressors are classified into a reciprocating compressor which compresses a refrigerant using a reciprocating motion of a piston, and a rotary compressor which compresses a refrigerant using a rotational motion. Depending on methods of transmitting driving power, the reciprocating compressors are classified into a crank compressor which transmits power to a plurality of pistons using a crank, and a swash plate compressor which transmits power to a shaft on which a swash plate is installed. The rotary compressors are classified into a vane rotary compressor which uses a rotating rotary shape and vanes, and a scroll compressor which uses an orbiting scroll and a fixed scroll.

The scroll compressor has an advantage in that the scroll compressor may obtain a relatively higher compression ratio than other compressors, smoothly perform processes of introducing, compressing, and discharging the refrigerant, and thus obtain stable torque. Therefore, the scroll compressor is widely used to compress the refrigerant in an air conditioning device or the like.

FIG. 1 is a cross-sectional view illustrating a scroll compressor in the related art.

Referring to the accompanying FIG. 1, a scroll compressor in the related art includes a housing 100, a motor 200 provided in the housing 100, a rotary shaft 300 configured to be rotated by the motor 200, an orbiting scroll 400 configured to orbit in conjunction with the rotary shaft 300, and a fixed scroll 500 configured to define a compression chamber C together with the orbiting scroll 400.

According to the scroll compressor in the related art configured as described above, when power is applied to the motor 200, the rotary shaft 300 rotates together with a rotor of the motor 200, the orbiting scroll 400 orbits in conjunction with the rotary shaft 300, and a refrigerant is introduced into and compressed in the compression chamber C by the orbiting motion of the orbiting scroll 400 and then discharged from the compression chamber C. The series of processes are repeated.

However, the scroll compressor in the related art has a problem in that a discharge amount of the refrigerant to be discharged from the compression chamber C is determined, which causes a limitation in improving the performance and efficiency of the compressor.

SUMMARY

An object of the present disclosure is to provide a scroll compressor capable of improving performance and efficiency of the compressor by increasing a discharge flow rate of a refrigerant to be discharged from a compression chamber.

Technical problems to be solved by the present disclosure are not limited to the above-mentioned technical problems, and other technical problems, which are not mentioned above, may be clearly understood from the following descriptions by those skilled in the art to which the present disclosure pertains.

To achieve the above-mentioned object, an embodiment of the present disclosure provides a scroll compressor including: a housing; a motor provided in the housing; a rotary shaft configured to be rotated by the motor; an orbiting scroll configured to orbit in conjunction with the rotary shaft; and a fixed scroll configured to define compression chambers together with the orbiting scroll, in which the housing includes: a center housing penetrated by the rotary shaft; a front housing configured to define a motor accommodation space that accommodates the motor; and a rear housing configured to define a discharge chamber for accommodating a refrigerant discharged from the compression chambers, and an introduction chamber for accommodating a middle-pressure refrigerant introduced from the outside of the housing, in which the fixed scroll has a plurality of injection ports that guides the refrigerant in the introduction chamber to the compression chambers, and in which when the plurality of injection ports faces an orbiting wrap of the orbiting scroll, at least one of the plurality of injection ports is closed by the orbiting wrap of the orbiting scroll so as not to communicate with the compression chambers.

According to the embodiment, an injection valve assembly may be provided between the fixed scroll and the rear housing and may open or close an injection flow path that guides the middle-pressure refrigerant from the introduction chamber to the plurality of injection ports.

According to the embodiment, when the plurality of injection ports faces the orbiting wrap, the compression chambers adjacent to the plurality of injection ports may not be in fluid communication with each other through the injection flow path of the injection valve assembly.

According to the embodiment, the injection valve assembly may include: a cover plate coupled to the rear housing and having one or more inflow ports into which the refrigerant in the introduction chamber is introduced; a valve plate coupled to the cover plate and having one or more inclined spaces which accommodate the refrigerant introduced through the inflow ports, and a plurality of outflow ports through which the refrigerant in the inclined space is discharged to the plurality of injection ports; and an injection valve interposed between the cover plate and the valve plate.

According to the embodiment, the plurality of injection ports may include: a first injection port disposed adjacent to an inner peripheral surface of a fixed wrap so as to communicate with an outer compression chamber defined by an outer peripheral surface of the orbiting wrap of the orbiting scroll and an inner peripheral surface of the fixed wrap of the fixed scroll; and a second injection port disposed adjacent to an outer peripheral surface of the fixed wrap so as to communicate with an inner compression chamber defined by an inner peripheral surface of the orbiting wrap of the orbiting scroll and an outer peripheral surface of the fixed wrap of the fixed scroll.

According to the embodiment, when the plurality of injection ports faces the orbiting wrap of the orbiting scroll, a pressure of the refrigerant in the compression chamber adjacent to the first injection port may be higher than a pressure of the refrigerant in the compression chamber adjacent to the second injection port.

According to the embodiment, the compression chambers may include: a pair of first compression chambers having the refrigerant at a pressure in a first pressure range; a pair of second compression chambers positioned to be closer to a centripetal side in a radial direction than the pair of first compression chambers to the centripetal side and having the refrigerant at a pressure in a second pressure range higher than the first pressure range; and a third compression chamber positioned to be closer to the centripetal side in the radial direction than the pair of second compression chambers to the centripetal side and having the refrigerant at a pressure in a third pressure range higher than the second pressure range, the pair of first compression chambers may include: a first outer compression chamber defined by the outer peripheral surface of the orbiting wrap and the inner peripheral surface of the fixed wrap; and a first inner compression chamber defined by the inner peripheral surface of the orbiting wrap and the outer peripheral surface of the fixed wrap, the pair of second compression chambers may include: a second outer compression chamber defined by the outer peripheral surface of the orbiting wrap and the inner peripheral surface of the fixed wrap; and a second inner compression chamber defined by the inner peripheral surface of the orbiting wrap and the outer peripheral surface of the fixed wrap, the first injection port may be capable of communicating with the second outer compression chamber, and the second injection port may be capable of communicating with the second inner compression chamber.

According to the embodiment, when the plurality of injection ports faces the orbiting wrap of the orbiting scroll, the first injection port may be disposed adjacent to the second inner compression chamber, and the second injection port may be disposed adjacent to the first outer compression chamber.

According to the embodiment, the first and second injection ports may each have a long hole shape, and a length of a minor axis of any one of the first and second injection ports may be shorter than a length of a minor axis of the other of the first and second injection ports.

According to the embodiment, a length of a major axis of the first injection port and a length of a major axis of the second injection port may be equal to each other.

According to the embodiment, an end of the orbiting wrap may include a planar portion and a pair of chamfers disposed at two opposite sides of the planar portion.

According to the embodiment, when the orbiting wrap faces the first and second injection ports, a radial outer edge, which defines the minor axis of the second injection port, may be positioned to be in contact with the planar portion of the orbiting wrap.

According to the embodiment, a length of the minor axis of the second injection port may be equal to or shorter than a length of the planar portion of the orbiting wrap.

According to the embodiment, when the orbiting wrap faces the first and second injection ports, a radial inner edge, which defines the minor axis of the first injection port, may be positioned to be in contact with the planar portion of the orbiting wrap.

According to the embodiment, a length of the minor axis of the first injection port may be equal to or shorter than a length of the planar portion of the orbiting wrap.

According to the embodiment, the injection valve assembly may further include a gasket retainer interposed between the cover plate and the valve plate and having one or more retainer portions inclinedly formed to allow the inflow port and the inclined space to communicate with each other, the injection valve may be interposed between the cover plate and the gasket retainer, and the gasket retainer and the injection valve may be compressed between the cover plate and the valve plate.

According to the present disclosure, not only the suction-pressure refrigerant, but also the middle-pressure refrigerant may be introduced into the compression chamber C of the scroll compressor, such that the discharge flow rate of the refrigerant discharged from the compression chamber may be increased, thereby improving the performance and efficiency of the compressor.

In addition, when the orbiting wrap of the orbiting scroll faces the injection port that guides the middle-pressure refrigerant to the compression chamber C, the injection port is closed so as not to communicate with the compression chamber adjacent to the injection port, that is, the injection port is sealed. Therefore, it is possible to prevent the internal leak through the injection port and improve the performance and durability of the compressor.

The effects of the present disclosure are not limited to the above-mentioned effects, and it should be understood that the effects of the present disclosure include all effects that may be derived from the detailed description of the present disclosure or the appended claims.

DETAILED DESCRIPTION OF EMBODIMENTS

Figure 1:
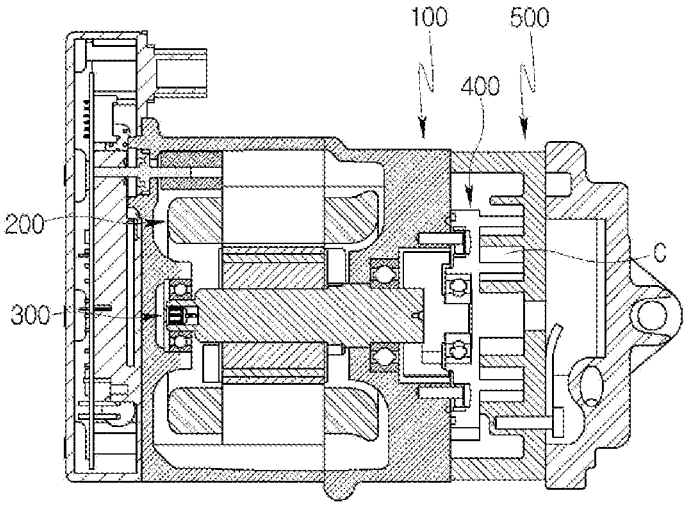
FIG. 1 Prior Art
FIG. 1 is a cross-sectional view illustrating a scroll compressor in the related art.

Hereinafter, exemplary embodiments of a scroll compressor according to the present disclosure will be described with reference to the accompanying drawings.

In addition, the terms used below are defined considering the functions in the present disclosure and may vary depending on the intention of a user or an operator or a usual practice. The following embodiments are not intended to limit the protection scope of the present disclosure but just exemplary constituent elements disclosed claims in the present disclosure.

A part irrelevant to the description will be omitted to clearly describe the present disclosure, and the same or similar constituent elements will be designated by the same reference numerals throughout the specification. Throughout the specification, unless explicitly described to the contrary, the word "comprise/include" and variations such as "comprises/includes" or "comprising/including" will be understood to imply the inclusion of stated elements, not the exclusion of any other elements.

First, a scroll compressor according to an embodiment of the present disclosure will be described with reference to FIGS. 2 to 12.

Figure 2:
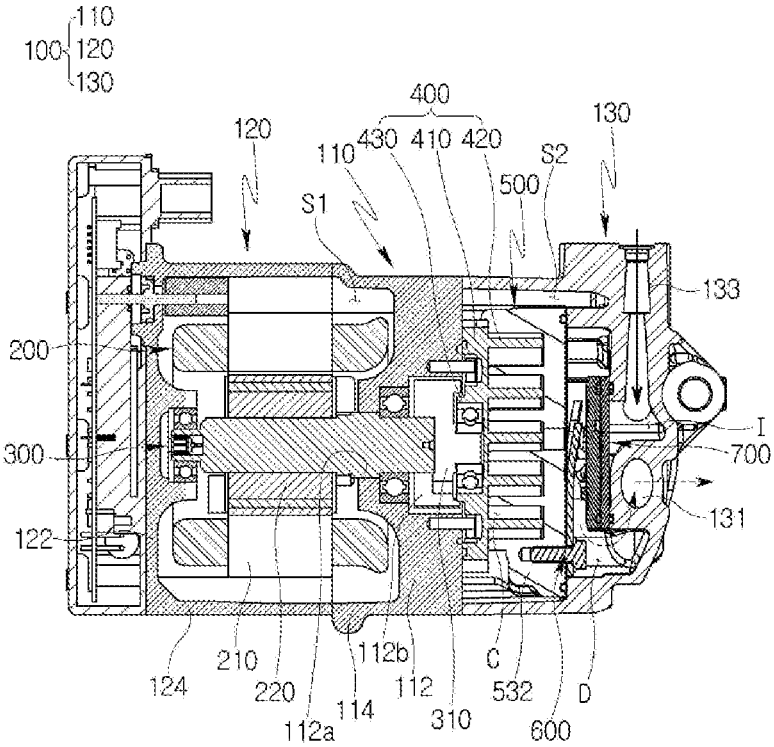
FIG. 2 is a cross-sectional view illustrating a scroll compressor according to an embodiment of the present disclosure.

As illustrated in FIG. 2, the scroll compressor according to the embodiment of the present disclosure may include a housing 100, a motor 200 provided in the housing 100, a rotary shaft 300 configured to be rotated by the motor 200, an orbiting scroll 400 configured to orbit in conjunction with the rotary shaft 300, a fixed scroll 500 configured to define compression chambers C together with the orbiting scroll 400, and a discharge valve 600 disposed on one surface of the fixed scroll 500 and configured to open or close a discharge opening 512 of the fixed scroll from which a refrigerant compressed in the compression chamber C is discharged.

Further, the compressor according to the present embodiment may further include an injection valve assembly 700 that defines and opens or closes an injection flow path configured to guide a middle-pressure refrigerant to the compression chamber C from the outside of the housing 100 (e.g., from a downstream side of a condenser in a vapor compression refrigeration cycle including a scroll compressor, the condenser, an expansion valve, and an evaporator.

In this case, the injection flow path includes an introduction port 133, an introduction chamber I, an inflow port 712, an inclined space 734, a connection flow path 738, an outflow port 736, and an injection port 514. The injection flow path extends from a rear housing 130 to the fixed scroll 500. The injection valve assembly 700 includes the inflow port 712, the inclined space 734, the connection flow path 738, and the outflow port 736 and may be interposed between the rear housing 130 and the fixed scroll 500.

Specifically, the housing 100 may include a center housing 110 penetrated by the rotary shaft 300, a front housing 120 configured to define, together with the center housing 110, a motor accommodation space S1 that accommodates the motor 200, and a rear housing 130 configured to define, together with the center housing 110, a scroll accommodation space S2 that accommodates the orbiting scroll 400 and the fixed scroll 500.

The center housing 110 may include a center end plate 112 configured to separate the motor accommodation space S1 and the scroll accommodation space S2 and support the orbiting scroll 400 and the fixed scroll 500, and a center side plate 114 protruding from an outer peripheral portion of the center end plate 112 toward the front housing 120.

The center end plate 112 has an approximately circular plate shape. A bearing hole 112*a* penetrated by one end of the rotary shaft 300 may be formed in a central portion of the center end plate 112. A back pressure chamber 112*b* configured to press the orbiting scroll 400 toward the fixed scroll 500 may be in the central portion of the center end plate 112. In this case, an eccentric bushing 310 is provided at one end of the rotary shaft 300 and converts a rotational motion of the rotary shaft 300 into an orbiting motion of the orbiting scroll 400. The back pressure chamber 112*b* sometimes provides a space in which the eccentric bushing 310 may rotate. Further, as described below, a suction flow path (not illustrated) may be formed on an outer peripheral portion of the center end plate 112 and guide the refrigerant, introduced into the motor accommodation space S1, to the scroll accommodation space S2.

The front housing 120 may include a front end plate 122 configured to face the center end plate 112 and support the other end of the rotary shaft 300, and a front side plate 124 protruding from an outer peripheral portion of the front end plate 122, fastened to the center side plate 114, and configured to support the motor 200. In this case, the center end plate 112, the center side plate 114, the front end plate 122, and the front side plate 124 may define the motor accommodation space S1. Further, a suction port (not illustrated) may be formed in the front side plate 124 and guide the refrigerant with a suction pressure to the motor accommodation space S1 from the outside.

As illustrated in FIGS. 3 to 6, the rear housing 130 may include a rear end plate 132 configured to face the center end plate 112, a first annular wall 134 protruding from the rear end plate 132 and positioned at an outermost peripheral side in a circumferential direction of the rear housing 130, a second annular wall 136 protruding from the rear end plate 132 and accommodated in the first annular wall 134, and a third annular wall 138 protruding from the rear end plate 132 and accommodated in the second annular wall 136. The first annular wall 134, the second annular wall 136, and the third annular wall 138 may have different heights.

The first annular wall 134 may have an annular shape having a diameter approximately equal in level to a diameter of the outer peripheral portion of the center end plate 112. The first annular wall 134 may be fastened to the outer peripheral portion of the center end plate 112 and define the scroll accommodation space S2.

The second annular wall 136 has an annular shape having a diameter smaller than a diameter of the first annular wall 134. The second annular wall 136 may come into contact with an outer peripheral portion of a fixed end plate 510 of the fixed scroll 500 to be described below. The second annular wall 136 may define a discharge chamber D that accommodates the refrigerant discharged from the compression chamber C. In this case, since the second annular wall 136 is formed to come into contact with the fixed end plate 510, the rear housing 130 may press the fixed scroll 500 toward the center housing 110 when the rear housing 130 is fastened to the center housing 110, thereby improving a fastening force between the fixed scroll 500 and the center housing 110 and preventing leakage.

The third annular wall 138 has an annular shape having a diameter smaller than a diameter of the second annular wall 136 and is spaced apart from the fixed end plate 510. The third annular wall 138 may be covered by a cover plate 710 of the injection valve assembly 700 to be described below, thereby defining the introduction chamber I that accommodates the refrigerant introduced through the introduction port 133.

A discharge port 131 is formed in the rear end plate 132 and guides the refrigerant in the discharge chamber D to the outside of the housing 100. The discharge port 131 extends in a radial direction of the rear end plate 132 from a central portion of the rear end plate 132 to one side of an outer peripheral portion of the rear end plate 132. Further, a discharge port inlet 131a may be formed in the rear end plate 132 and guide the refrigerant in the discharge chamber D to the discharge port 131. Meanwhile, a tubular oil separator (not illustrated) may be provided in the discharge port 131 and separate oil from the refrigerant.

In addition, the introduction port 133 is also formed in the rear end plate 132, and the middle-pressure refrigerant is introduced into the introduction port 133 from the outside of the housing 100. The introduction port 133 may extend in the radial direction of the rear end plate 132 from the other side of the outer peripheral portion of the rear end plate 132 to the central portion of the rear end plate 132 and communicate with the introduction chamber I.

As described above, the rear housing 130 may have the discharge chamber D, the discharge port 131, the introduction port 133, and the introduction chamber I. At least a part of the introduction chamber I may be accommodated in the discharge chamber D, at least a part of the discharge port 131 may be accommodated in the introduction chamber I, and at least a part of the introduction port 133 may be accommodated in the discharge chamber D.

Specifically, at least a part of the introduction chamber I may be accommodated in the discharge chamber D when the third annular wall 138 is accommodated in the second annular wall 136 and the third annular wall 138 is spaced apart from the fixed end plate 510 and covered by the injection valve assembly 700. That is, a lateral portion of the introduction chamber I may overlap the discharge chamber D in the radial direction of the rear housing 130 with the third annular wall 138 interposed therebetween. A tip portion of the introduction chamber I may overlap the discharge chamber D in an axial direction of the rear housing 130 with the injection valve assembly 700 interposed therebetween.

Further, the third annular wall 138 may have a fastening groove 138*a* and a first positioning groove 138*b*. A fastening bolt 770 for fastening the injection valve assembly 700 to the third annular wall 138 may be inserted into the fastening groove 138*a*. Positioning pins 780 for aligning the cover plate 710, an injection valve 720, and a valve plate 730 of the injection valve assembly 700 with predetermined positions may be inserted into the first positioning groove 138*b*.

As illustrated in FIG. 2, the motor 200 may include a stator 210 fixed to the front side plate 124, and a rotor 220 configured to be rotated in the stator 210 by an interaction with the stator 210.

The rotary shaft 300 is fastened to the rotor 220 and penetrates a central portion of the rotor 220, such that one end of the rotary shaft 300 may penetrate the bearing hole 112*a* of the center end plate 112, and the other end of the rotary shaft 300 may be supported on the front end plate 122.

The orbiting scroll 400 may be interposed between the center end plate 112 and the fixed scroll 500 include an orbiting end plate 410 having a circular plate shape, an orbiting wrap 420 protruding from a central portion of the orbiting end plate 410 toward the fixed scroll 500, and a boss part 430 protruding from the central portion of the orbiting end plate 410 in a direction opposite to the orbiting wrap 420 and fastened to the eccentric bushing 310.

Figure 3:
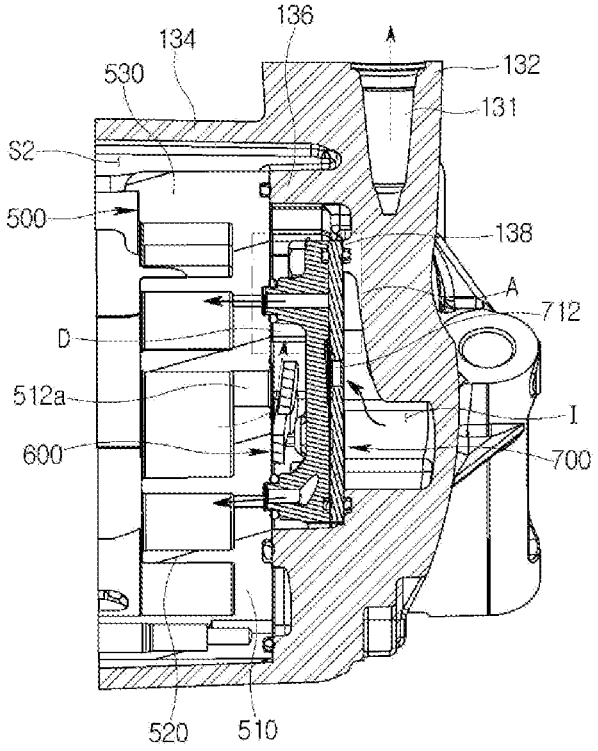
FIG. 3 is a cross-sectional view illustrating a rear housing of the scroll compressor illustrated in FIG. 2 when viewed in another direction.
Figure 4:
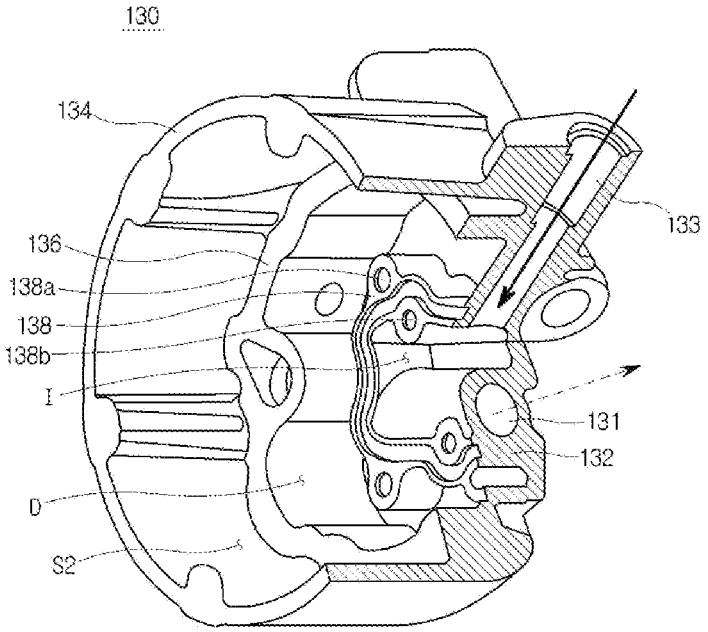
FIG. 4 is a partially cross-sectional perspective view illustrating a state in which the rear housing is separated from the scroll compressor illustrated in FIG. 2.
Figure 5:
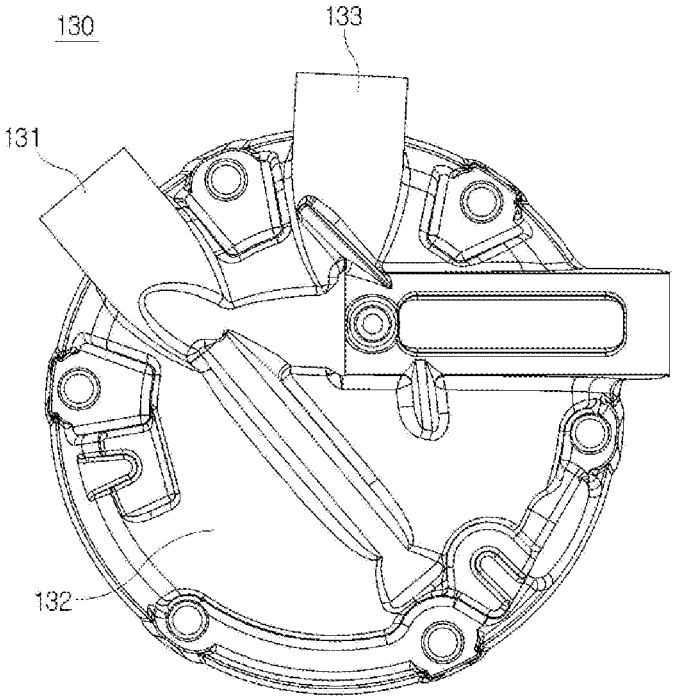
FIG. 5 is a front view illustrating a state in which the rear housing is separated from the scroll compressor illustrated in FIG. 2.
Figure 6:
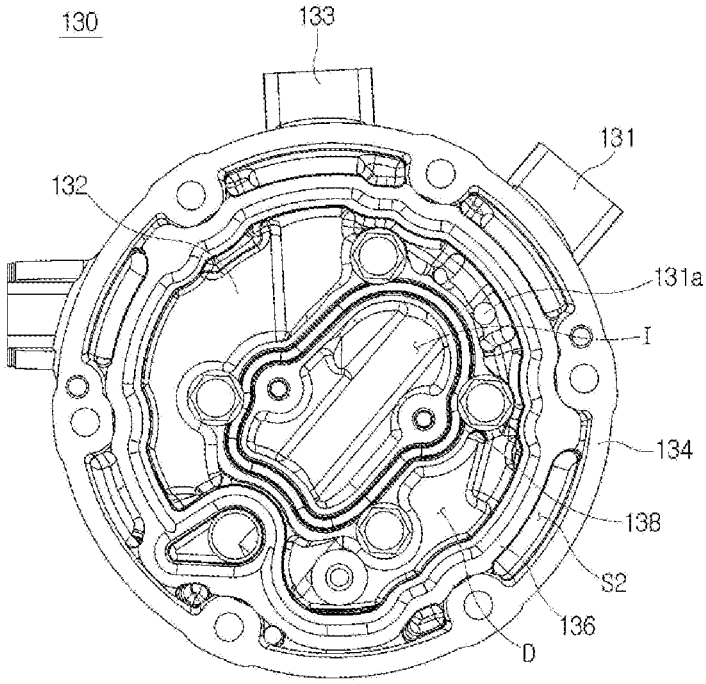
FIG. 6 is a rear view of FIG. 5.
Figure 7:
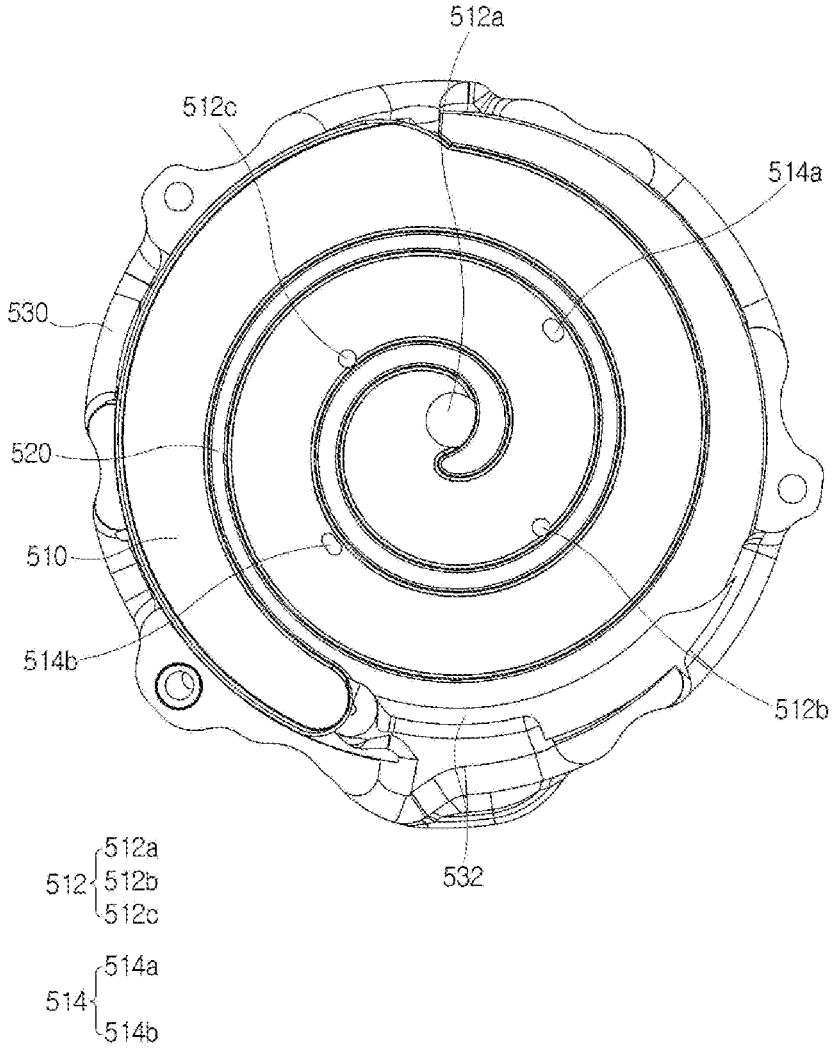
FIG. 7 is a rear view of a fixed scroll of the scroll compressor illustrated in FIG. 2.
Figure 8:
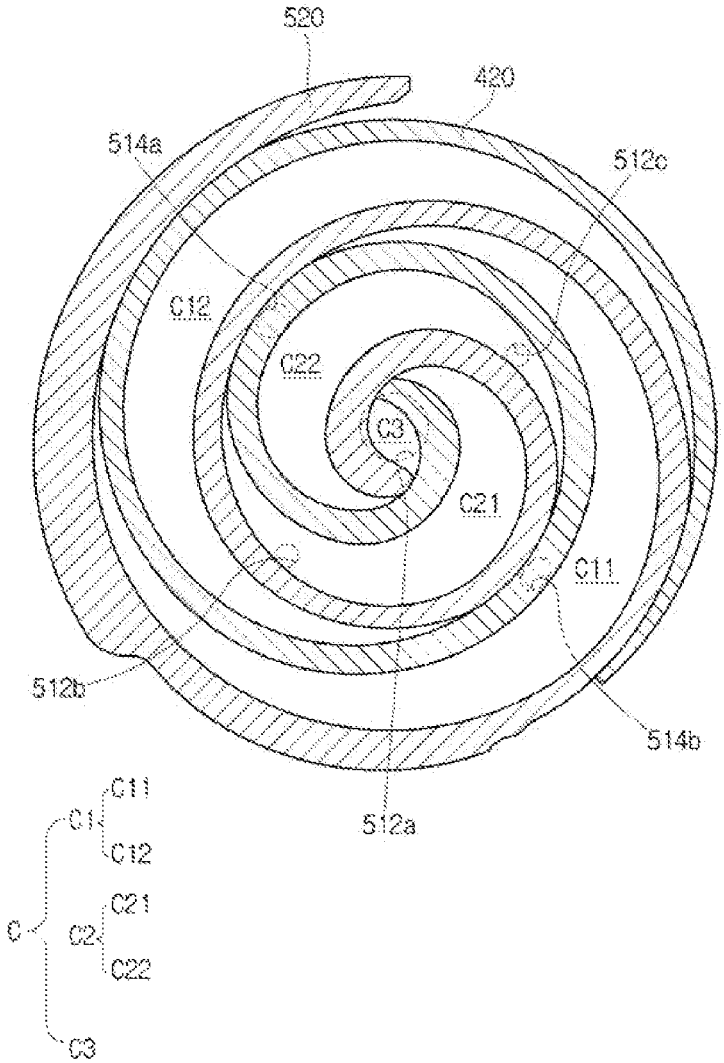
FIGS. 8 to 11 are cross-sectional views illustrating a fixed wrap, an orbiting wrap, and an injection port when a rotation angle of a rotary shaft is first, second, third, and fourth angles.
Figure 9:
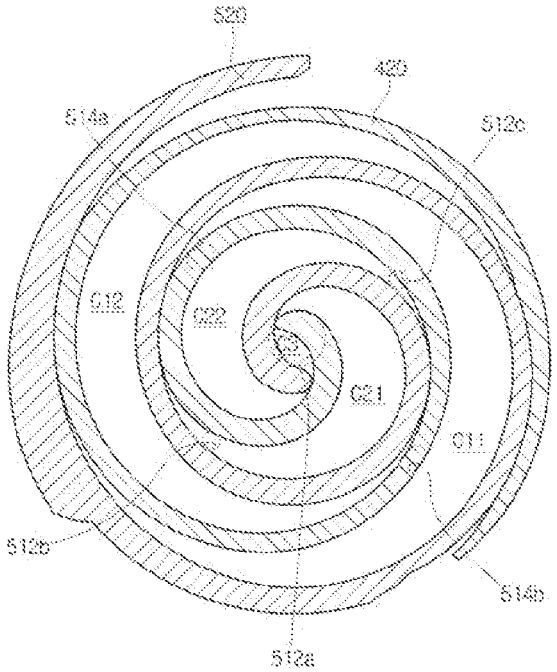
Figure 10:
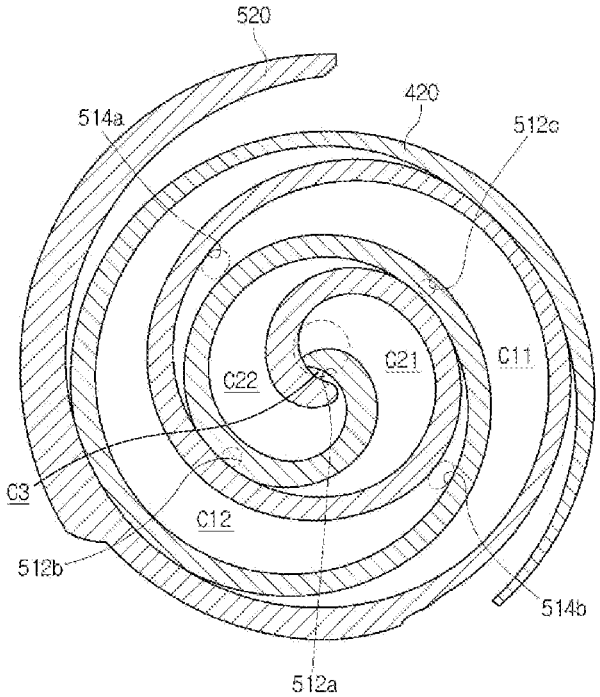

As illustrated in FIGS. 3 and 7, the fixed scroll 500 may include the fixed end plate 510 having a circular plate shape, a fixed wrap 520 protruding from a central portion of the fixed end plate 510 and configured to engage with the orbiting wrap 420, and a fixed side plate 530 protruding from an outer peripheral portion of the fixed end plate 510 and fastened to the center end plate 112.

The fixed end plate 510 may include the discharge opening 512 from which the refrigerant in the compression chamber C is discharged to the discharge chamber D, and the injection port 514 configured to guide the refrigerant, discharged from the injection valve assembly 700, to the compression chamber C. The discharge opening 512 may be provided in plural to prevent the refrigerant from being excessively compressed. The plurality of discharge openings 512 may be opened or closed by the discharge valve 600 interposed between the fixed end plate 510 and the injection valve assembly 700.

For example, the fixed wrap 520 may extend in a logarithmic spiral shape from a center to an outer peripheral portion of the fixed scroll 500. The fixed side plate 530 may include a fixed wrap introduction part 532 having an annular shape extending along the outer peripheral portion of the fixed end plate 510 and having one side connected to the fixed wrap 520.

An axial height of the fixed wrap introduction part 532 may be equal in level to an axial height of the fixed wrap 520 to prevent the refrigerant in the compression chamber C from leaking through the fixed wrap introduction part 532. In addition, a radial thickness of the fixed wrap introduction part 532 is larger than a radial thickness of the fixed wrap 520 to improve support rigidity of the fixed wrap 520. In this case, to reduce the weight and costs of the fixed scroll 500, the fixed side plate 530 may be formed such that a radial thickness of a portion, except for the fixed wrap introduction part 532, may be smaller than the radial thickness of the fixed wrap introduction part 532.

Specifically, as illustrated in FIGS. 8 to 11, the compression chamber C may include a first compression chamber C1 positioned at a centrifugal side in a radial direction of the scroll accommodation space S2 and having the refrigerant at a pressure in a first pressure range, a second compression chamber C2 positioned to be closer to a centripetal side in the radial direction of the scroll accommodation space S2 than the first compression chamber C1 to the centripetal side and having the refrigerant at a pressure in a second pressure range higher than the first pressure range, and a third compression chamber C3 positioned to be closer to the centripetal side in the radial direction of the scroll accommodation space S2 than the second compression chamber C2 to the centripetal side and having the refrigerant at a pressure in a third pressure range higher than the second pressure range. The two first compression chambers C1, the two second compression chambers C2 may be respectively provided in pairs.

The first compression chambers C1 may include a first outer compression chamber C11 defined by an outer peripheral surface of the orbiting wrap 420 and an inner peripheral surface of the fixed wrap 520, and a first inner compression chamber C12 defined by an inner peripheral surface of the orbiting wrap 420 and an outer peripheral surface of the fixed wrap 520.

The second compression chambers C2 may include a second outer compression chamber C21 defined by the outer peripheral surface of the orbiting wrap 420 and the inner peripheral surface of the fixed wrap 520, and a second inner compression chamber C22 defined by the inner peripheral surface of the orbiting wrap 420 and the outer peripheral surface of the fixed wrap 520.

In this case, the discharge opening 512 may include a main discharge opening 512*a* formed adjacent to a center of the fixed end plate 510 to discharge the refrigerant in the third compression chamber C3, a first sub-discharge opening 512*b* formed outside the main discharge opening 512*a* in a radial direction of the fixed end plate 510 to discharge the refrigerant in the second outer compression chamber C21, and a second sub-discharge opening 512*c* formed outside the main discharge opening 512*a* in the radial direction of the fixed end plate 510 and disposed opposite to the first sub-discharge opening 512*b* based on the main discharge opening 512*a* to discharge the refrigerant in the second inner compression chamber C22.

In addition, the injection port 514 may be provided in plural to supply the refrigerant, discharged from the injection valve assembly 700, to both the pair of first compression chambers C1. That is, the injection ports 514 may include a first injection port 514*a* that may communicate with the first outer compression chamber C11, and a second injection port 514*b* that may communicate with the first inner compression chamber C12. The first injection port 514*a* and the second injection port 514*b* may be formed opposite to each other based on an imaginary line that connects the first sub-discharge opening 512*b* and the second sub-discharge opening 512*c*.

Figure 12:
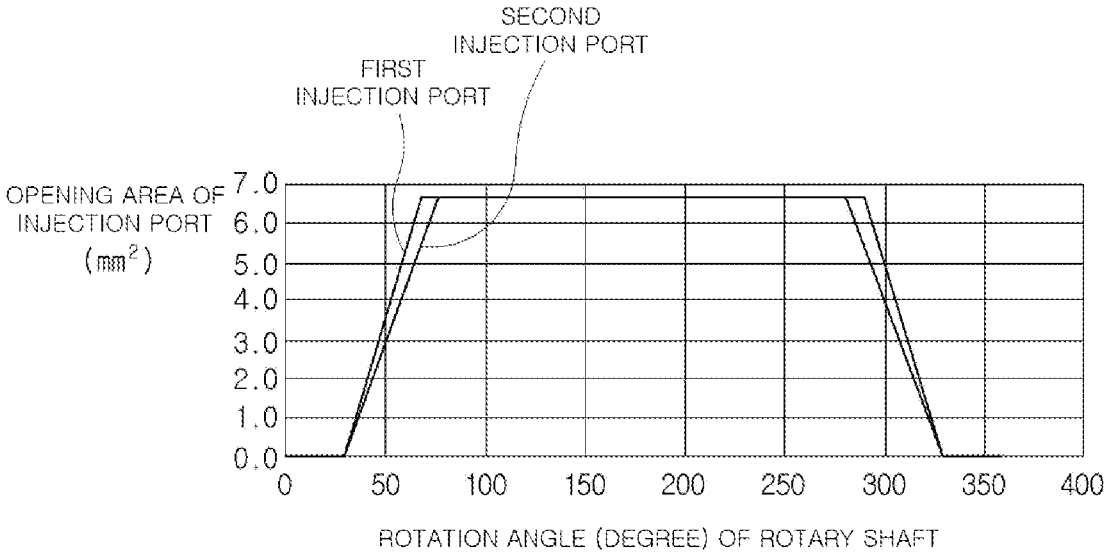
FIG. 12 is a graph illustrating a timing of opening or closing an injection port.

In this case, the injection ports 514 may simultaneously communicate with the first outer compression chamber C11 and the second inner compression chamber C12 so that pressure imbalance does not occur between the first outer compression chamber C11 and the first inner compression chamber C12. That is, as illustrated in FIG. 12, when the communication between the first injection port 514*a* and the first outer compression chamber C11 is initiated, the communication between the second injection port 514*b* and the first inner compression chamber C12 may be initiated.

In addition, particularly, the injection ports 514 may be blocked simultaneously with the first outer compression chamber C11 and the first inner compression chamber C12. That is, as illustrated in FIG. 12, when the communication between the first injection port 514*a* and the first outer compression chamber C11 is blocked, the communication between the first injection port 514*b* and the first inner compression chamber C12 may be blocked.

Figure 11:
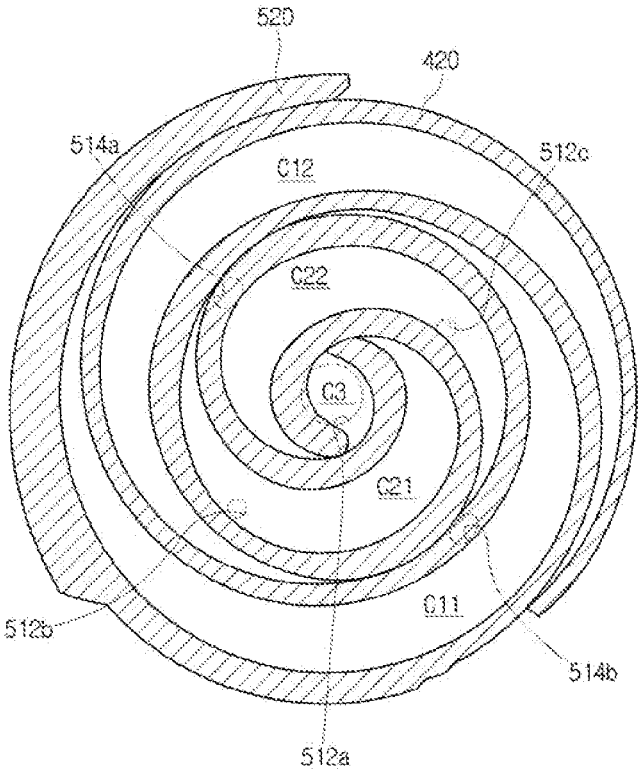
Figure 13:
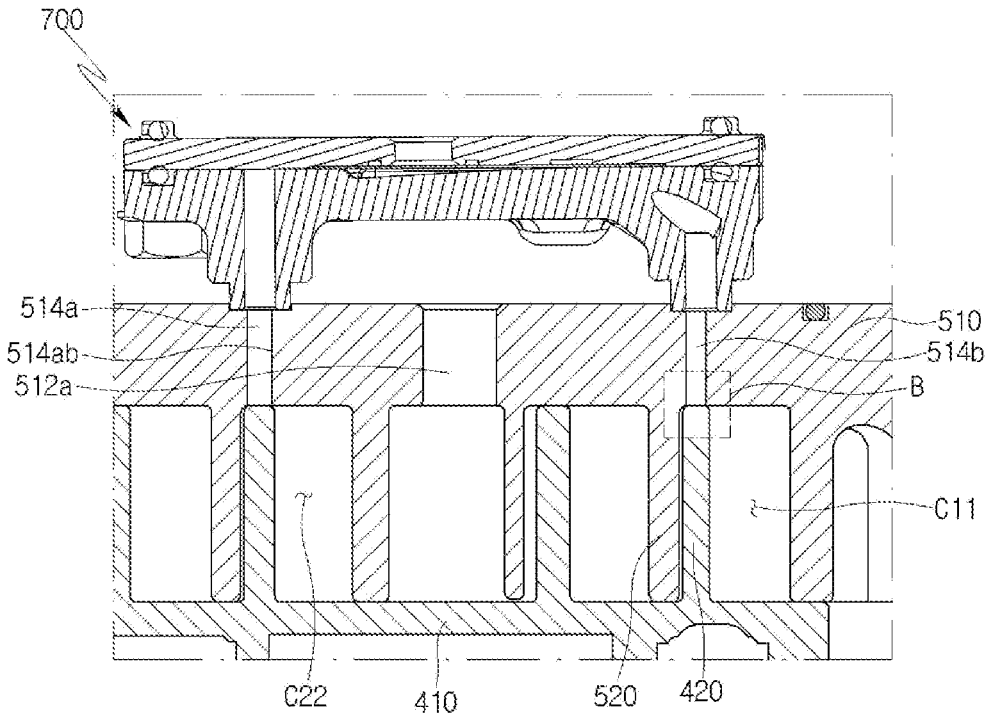
FIG. 13 is a cross-sectional view illustrating a state in which an orbiting scroll and the fixed scroll illustrated in FIG. 11 are arranged.

In this case, as illustrated in FIGS. 11 and 13, as the refrigerant is compressed by the operation of the scroll compressor, the orbiting wrap 420 of the orbiting scroll instantaneously overlap the first and second injection ports 514*a* and 514*b*, i.e., the first and second injection ports 514*a* and 514*b* instantaneously face the orbiting wrap 420 of the orbiting scroll.

In this case, the first injection port 514*a*, which may communicate with the first outer compression chamber C11, i.e., the first injection port 514*a* disposed adjacent to the inner peripheral surface of the fixed wrap 520 is disposed adjacent to the second inner compression chamber C22. In contrast, the second injection port 514*b*, which may communicate with the first inner compression chamber C12, i.e., the second injection port 514*b* disposed adjacent to the outer peripheral surface of the fixed wrap 520 is disposed adjacent to the first outer compression chamber C11.

Because the pressure in the second inner compression chamber C22 is higher than the pressure in the first outer compression chamber C11, the high-pressure refrigerant leaking through the first injection port 514*a* adjacent to the second inner compression chamber C22 may flow into the first outer compression chamber C11 through the second injection port 514*b* via the injection flow path of the injection valve assembly 700 to be described below.

Specifically, the high-pressure refrigerant leaking through the first injection port 514*a* adjacent to the second inner compression chamber C22 flows into the inclined space 734 through a first outflow port 736*a* and a first connection flow path 738*a* to be described below, flows into the second injection port 514*b* through a second connection flow path 738*b* and a second outflow port 736*b*, and flows into the first outer compression chamber C11. If an internal leak occurs as described above, a discharge temperature increases, and a problem occurs in terms of durability of the compressor.

Therefore, according to the present disclosure, the shape of the injection port is adjusted, and the injection port is sealed to prevent the internal leak of the refrigerant.

In the present embodiment, the first and second injection ports 514*a* and 514*b* each have a long hole shape having a minor axis and a major axis to increase a flow rate of the refrigerant to be injected into the compression chamber C. In addition, the first and second injection ports 514*a* and 514*b* may each have a constant cross-sectional shape to prevent a loss of pressure and flow rate while the refrigerant passes through the injection port. That is, an inner diameter of each of the first and second injection ports 514*a* and 514*b* may be a predetermined value regardless of an axial position of the injection port.

In this case, a position of a radial outer edge 514*ba,* which defines a minor axis of the second injection port 514*b,* i.e., a position of the outer edge 514*ba* adjacent to the first outer compression chamber C11 is restricted, such that the second injection port 514*b* and the first outer compression chamber C11 may be sealed without communicating with each other.

Figure 14:
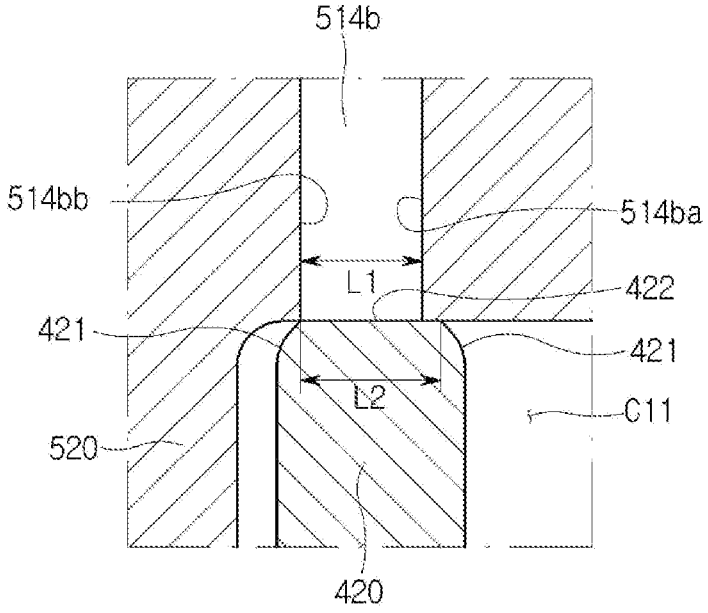
FIG. 14 is an enlarged view of part B in FIG. 13.

As illustrated in FIG. 14, each of the ends of the orbiting wrap 420 has a planar portion 422 and a pair of chamfers 421 disposed at two opposite sides of the planar portion 422. During the process of manufacturing the fixed scroll, a portion connecting the fixed end plate 510 and the fixed wrap 520 needs to be rounded. To avoid this process, the two opposite sides of the end of the orbiting wrap 420 need to be formed as the chamfers 421.

Specifically, when the second injection port 514*b* faces the orbiting wrap 420, the outer edge 514*ba* of the second injection port 514*b* is in contact with the planar portion 422 except for the chamfer 421 of the orbiting wrap 420. Therefore, the refrigerant in the second injection port 514*b* does not leak into the first outer compression chamber C11 through the chamfer 421 of the orbiting wrap 420. That is, when the orbiting wrap 420 of the orbiting scroll overlaps the first and second injection ports 514*a* and 514*b,* there is no concern that the refrigerant leaks into the first outer compression chamber C11 through the second injection port 514*b* even though the refrigerant leaks through the first injection port 514*a* adjacent to the second inner compression chamber C22. Therefore, it is possible to prevent the internal leak.

In this case, there is a low likelihood that the refrigerant leaks because the fixed wrap 520 is disposed radially inside the second injection port 514*b.* Therefore, a position of a radial inner edge 514*bb,* which defines a minor axis of the second injection port 514*b,* i.e., a position of the inner edge 514*bb* adjacent to the fixed wrap 520 is not restricted.

However, to more assuredly ensure the sealing effect, the inner edge 514*bb* of the second injection port 514*b* may also be positioned to be in contact with the planar portion 422 except for the chamfer 421 of the orbiting wrap 420. That is, as illustrated in FIG. 14, a length L1 of the minor axis of the second injection port 514*b* may be equal to or shorter than a length L2 of the planar portion 422 except for the chamfer 421 of the orbiting wrap.

In this case, as illustrated in FIG. 13, the minor axis of the first injection port 514*a* is longer than the minor axis of the second injection port 514*b.* That is, the first injection port 514*a* and the second injection port 514*b* are formed asymmetrically. Therefore, it is possible to prevent the internal leak while sufficiently exhibiting the performance without a loss of pressure of the refrigerant to be supplied through the injection port 514.

However, the major axis of the first injection port 514*a* is equal in length to the major axis of the second injection port 514*b.* Therefore, the timings of opening or closing the first injection port 514*a* and the second injection port 514*b* may be kept equal to each other.

However, the present disclosure is not limited thereto. It is possible to basically block the leakage of the refrigerant from the high-pressure second inner compression chamber C22 to the first injection port 514*a.* To this end, when the first injection port 514*a* faces the orbiting wrap 420, the radial inner edge 514*ab,* which defines the minor axis of the first injection port 514*a,* i.e., the inner edge 514*ab* adjacent to the second inner compression chamber C22 may be positioned to be in contact with the planar portion 422 except for the chamfer 421 of the orbiting wrap 420. Therefore, the refrigerant in the second inner compression chamber C22 does not leak into the first injection port 514*a* through the chamfer 421 of the orbiting wrap 420. In addition, a length of the minor axis of the first injection port 514*a* may be equal to or shorter than the length L2 of the planar portion 422 except for the chamfer 421 of the orbiting wrap.

Figure 15:
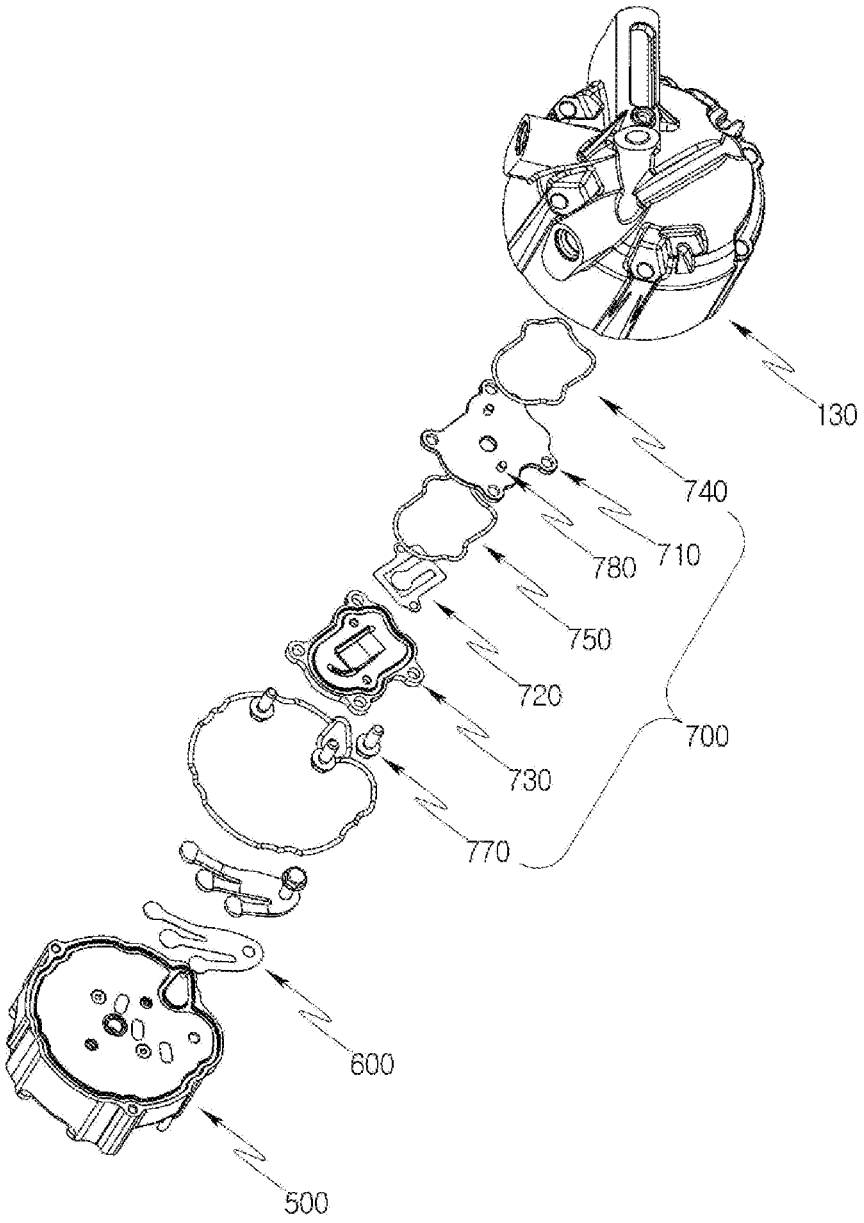
FIG. 15 is an exploded perspective view illustrating the rear housing of the scroll compressor illustrated in FIG. 2 and components accommodated in the rear housing.

Next, the discharge valve 600 will be described with reference to FIGS. 15 and 16. The discharge valve 600 is interposed between the fixed end plate 510 and the injection valve assembly 700 and serves to allow the discharge opening 512 and the discharge chamber D to communicate with each other or block the communication between the discharge opening 512 and the discharge chamber D.

The discharge valve 600 may include a main opening/closing part 610 configured to open or close the main discharge opening 512*a,* a first sub-opening/closing part 630 configured to open or close the first sub-discharge opening 512*b,* a second sub-opening/closing part 650 configured to open or close the second sub-discharge opening 512*c,* a fastening part 670 fastened to the fixed end plate 510, a main support part 620 extending from the main opening/closing part 610 to the fastening part 670, a first sub-support part 640 extending from the first sub-opening/closing part 630 to the fastening part 670, and a second sub-support part 660 extending from the second sub-opening/closing part 650 to the fastening part 670.

According to the discharge valve 600, the main opening/closing part 610, the first sub-opening/closing part 630, the second sub-opening/closing part 650, the fastening part 670, the main support part 620, the first sub-support part 640, and the second sub-support part 660 may be integrated to minimize increases in costs and weight caused by the discharge valve 600. In addition, a circumferential width of the fastening part 670 is smaller than a distance between the first sub-opening/closing part 630 and the second sub-opening/closing part 650. The fastening part 670 may be fastened to the fixed end plate 510 by means of a single fastening member 680. In this case, the single fastening member 680 may be fastened to the fixed wrap introduction part 532 having a relatively large thickness and height so that the discharge valve 600 may be sufficiently supported even though the discharge valve 600 is fastened to the fixed end plate 510 by means of the single fastening member 680.

In addition, to prevent at least one of the first sub-support part 640 and the second sub-support part 660 from interfering with the injection port 514, at least one of the first sub-support part 640 and the second sub-support part 660 may include an avoidance part 690 indented toward the main support part 620.

In this case, when the pressure in the third compression chamber C3 reach a level of a discharge pressure, the main opening/closing part 610 opens the main discharge opening 512*a*. In this case, when the pressure in the second outer compression chamber C21 is higher than the second pressure range, the first sub-opening/closing part 630 opens the first sub-discharge opening 512*b* to decrease the pressure in the second outer compression chamber C21 to a level included in the second pressure range. When the pressure in the second inner compression chamber C22 higher than the second pressure range, the second sub-opening/closing part 650 opens the second sub-discharge opening 512*c* to decrease the pressure in the second inner compression chamber C22 to a level included in the second pressure range. As a result, it is possible to prevent the pressure of the refrigerant discharged from the main discharge opening 512*a* from becoming excessively higher than the discharge pressure. That is, the excessive compression may be prevented.

Meanwhile, the first sub-discharge opening 512*b* and the second sub-discharge opening 512*c* may simultaneously communicate with the second outer compression chamber C21 and the second inner compression chamber C22 so that pressure imbalance does not occur between the second outer compression chamber C21 and the second inner compression chamber C22. That is, when the communication between the first sub-discharge opening 512*b* and the second outer compression chamber C21 is initiated, the communication between the second sub-discharge opening 512*c* and the second inner compression chamber C22 may be initiated.

Further, particularly, the first sub-discharge opening 512*b* and the second sub-discharge opening 512*c* may be blocked simultaneously with the second outer compression chamber C21 and the second inner compression chamber C22. That is, when the communication between the first sub-discharge opening 512*b* and the second outer compression chamber C21 is blocked, the communication between the second sub-discharge opening 512*c* and the second inner compression chamber C22 may be blocked.

Next, the injection valve assembly 700 will be described below in detail with reference to FIGS. 15 and 17 to 20. The injection valve assembly 700 may be disposed on a tip surface of the third annular wall 138 so as to allow the introduction chamber I and the injection port 514 to communicate with each other or block the communication between the introduction chamber I and the injection port 514.

Specifically, the injection valve assembly 700 may include the cover plate 710 fastened to the tip surface of the third annular wall 138 and configured to cover the introduction chamber I, the valve plate 730 fastened to the cover plate 710 and disposed opposite to the introduction chamber I based on the cover plate 710, and the injection valve 720 interposed between the cover plate 710 and the valve plate 730.

Figure 17:
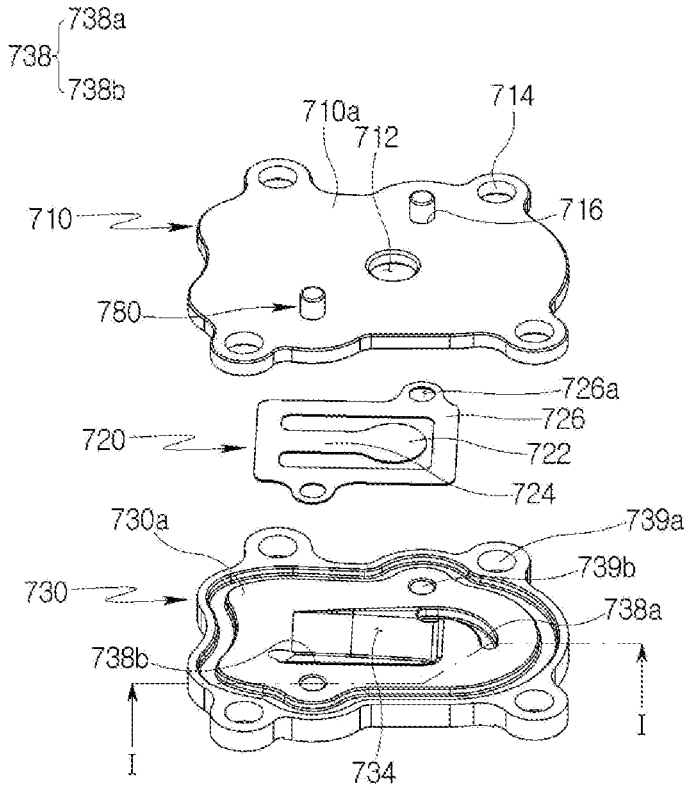
FIG. 17 is an exploded perspective view illustrating an injection valve assembly among the components illustrated in FIG. 15.
Figure 18:
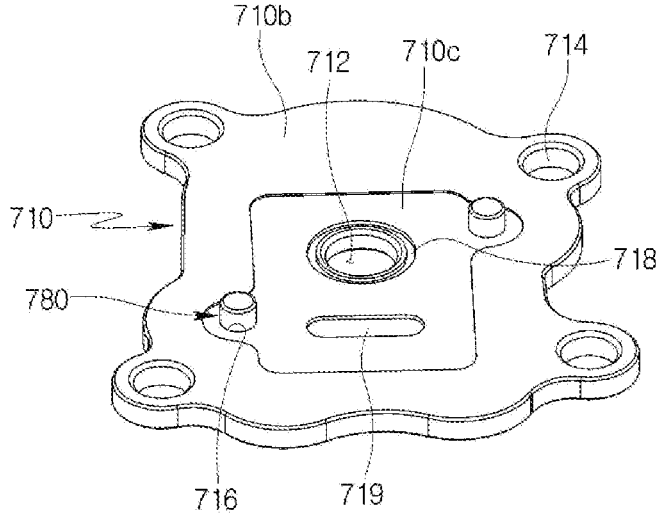
FIG. 18 is a perspective view illustrating a rear surface of a cover plate of the injection valve assembly illustrated in FIG. 17.

As illustrated in FIGS. 17 and 18, the cover plate 710 may include a cover plate upper surface 710*a* configured to face the third annular wall 138, a cover plate lower surface 710*b* configured to face the valve plate 730 and the injection valve 720, and an injection valve seating groove 710*c* provided in a central portion of the cover plate 710 and formed to be indented from the cover plate lower surface 710*b*.

In addition, the cover plate 710 may further include the inflow port 712 configured to allow the introduction chamber I and the inclined space 734 to be described below to communicate with each other, a second fastening hole 714 configured to communicate with the fastening groove 138*a* and be penetrated by the fastening bolt 770, and a first positioning hole 716 configured to communicate with the first positioning groove 138*b* and be penetrated by the positioning pin 780.

The inflow port 712 is provided in the central portion of the cover plate 710 and penetratively formed from the cover plate upper surface 710*a* to the injection valve seating groove 710*c*. The second fastening hole 714 is provided in the outer peripheral portion of the cover plate 710 and penetratively formed from the cover plate upper surface 710*a* to the cover plate lower surface 710*b*. In addition, the first positioning hole 716 is formed between the inflow port 712 and the second fastening hole 714 in the radial direction of the cover plate 710 and penetratively formed from the cover plate upper surface 710*a* to the injection valve seating groove 710*c* or the cover plate lower surface 710*b*.

As illustrated in FIG. 17, the injection valve 720 may include a head portion 722 configured to open or close the inflow port 712, a leg portion 724 configured to support the head portion 722, and a peripheral portion 726 configured to support the leg portion 724. The head portion 722 may have a circular plate shape having an outer diameter larger than an inner diameter of the inflow port 712. The leg portion 724 may have a plate shape extending in one direction from the head portion 722 to one side of the peripheral portion 726. In addition, the peripheral portion 726 may have a ring shape that accommodates the head portion 722 and the leg portion 724 while being accommodated in the injection valve seating groove 710*c*. For example, in the present embodiment, the peripheral portion 726 may have a quadrangular ring shape. The peripheral portion 726 may include second positioning holes 726*a* configured to communicate with the first positioning hole 716 and be penetrated by the positioning pins 780.

In this case, the injection valve 720 is fixed, without a separate fastening member for fixing the injection valve 720, as the peripheral portion 726 is compressed between the injection valve seating groove 710*c* and the valve plate 730. To this end, an axial thickness of the peripheral portion 726 may be equal to or larger than an axial depth of the injection valve seating groove 710*c* (more accurately, a distance between a base surface of the injection valve seating groove 710*c* and a valve plate upper surface 730*a* to be described below). In this case, an axial thickness of the peripheral portion 726 may be designed to be larger than an axial depth of the injection valve seating groove 710*c* to prevent a case in which the peripheral portion 726 is not compressed between the injection valve seating groove 710*c* and the valve plate 730 because of tolerance.

Figure 19:
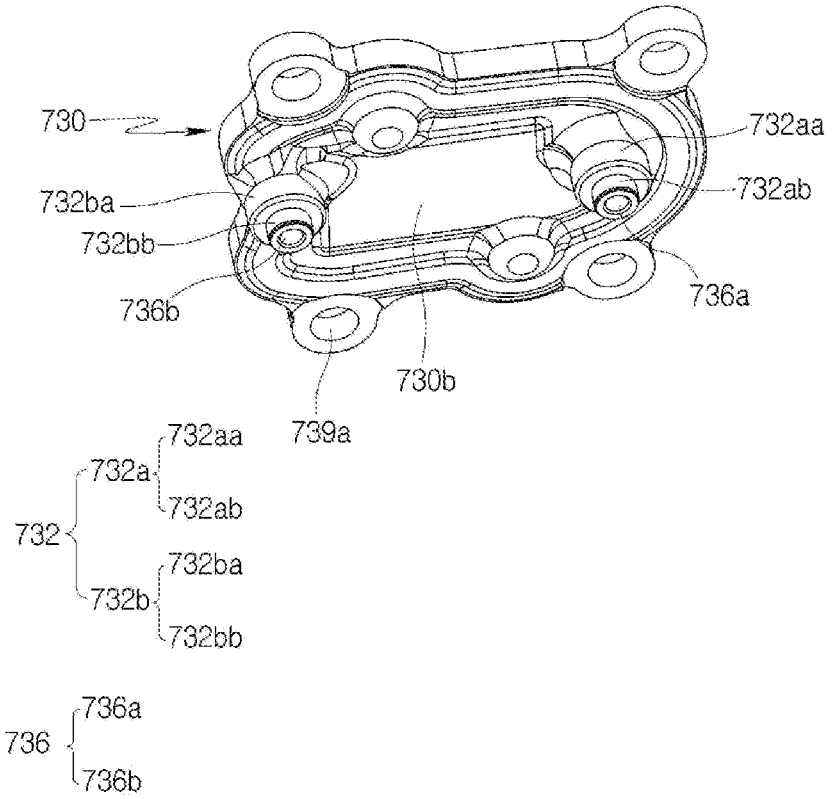
FIG. 19 is a perspective view illustrating a rear surface of a valve plate of the injection valve assembly illustrated in FIG. 17.
Figure 20:
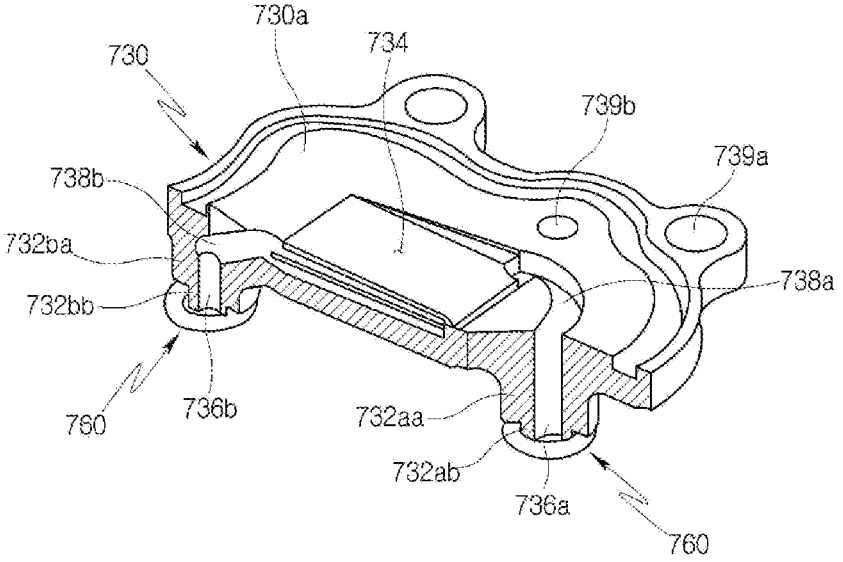
FIG. 20 is a perspective view taken along line I-I in FIG. 17.

As illustrated in FIGS. 17, 19, and 20, the valve plate 730 may include the valve plate upper surface 730*a* configured to face the cover plate 710 and the injection valve 720, and a valve plate lower surface 730*b* configured to face the fixed scroll 500 while defining a rear surface of the valve plate upper surface 730*a*.

In addition, the valve plate 730 may further include a protruding portion 732 protruding from the valve plate lower surface 730*b* toward the first injection port 514*a* and the second injection port 514*b*. That is, the valve plate 730 may include a first protruding portion 732*a* protruding from one side of the valve plate lower surface 730*b* toward the first injection port 514*a*, and a second protruding portion 732*b* protruding from the other side of the valve plate lower surface 730*b* toward the second injection port 514*b*.

In this case, the first protruding portion 732*a* may include a first large diameter portion 732*aa* protruding from one side of the valve plate lower surface 730*b* toward the first injection port 514*a*, and a first small diameter portion 732*ab* further protruding from the first large diameter portion 732*aa* toward the first injection port 514*a*. An outer diameter of the first large diameter portion 732*aa* is larger than an outer diameter of the first small diameter portion 732*ab*.

Likewise, the second protruding portion 732*b* may also include a second large diameter portion 732*ba* protruding from the other side of the valve plate lower surface 730*b* toward the second injection port 514*b*, and a second small diameter portion 732*bb* further protruding from the second large diameter portion 732*ba* toward the second injection port 514*b*. An outer diameter of the second large diameter portion 732*ba* is larger than an outer diameter of the second small diameter portion 732*bb*.

In addition, the valve plate 730 may further include the inclined space 734 configured to serve as a retainer for the injection valve 720 and accommodate the refrigerant introduced through the inflow port 712, the first outflow port 736*a* formed in the first protruding portion 732*a* and configured to communicate with the first injection port 514*a*, the second outflow port 736*b* formed in the second protruding portion 732*b* and configured to communicate with the second injection port 514*b*, the first connection flow path 738*a* configured to guide the refrigerant in the inclined space 734 to the first outflow port 736*a*, and the second connection flow path 738*b* configured to guide the refrigerant in the inclined space 734 to the second outflow port 736*b*.

The valve plate upper surface 730*a* may be formed as a flat surface that is in contact with the peripheral portion 726 of the injection valve 720 and the cover plate lower surface 710*b*. The inclined space 734 may be recessed from the valve plate upper surface 730*a*. The inclined space 734 may include a retainer surface that supports the head portion 722 and the leg portion 724 of the injection valve 720 when the injection valve 720 opens the inflow port 712, i.e., when the inflow port 712 is opened as the head portion 722 and the leg portion 724 of the injection valve 720 moves toward the valve plate 730 relative to the peripheral portion 726.

The first outflow port 736*a* is recessed from a tip surface of the first protruding portion 732*a*, more accurately, a tip surface of the first small diameter portion 732*ab*. The first outflow port 736*a* may extend to the first large diameter portion 732*aa*. The second outflow port 736*b* is recessed from a tip surface of the second protruding portion 732*b*, more accurately, a tip surface of the second small diameter portion 732*bb*. The second outflow port 736*b* may extend to the second large diameter portion 732*ba*.

The first connection flow path 738*a* may be recessed from the valve plate upper surface 730*a* and allow one side of the inclined space 734 to communicate with the first outflow port 736*a*. In addition, the second connection flow path 738*b* may be recessed from the valve plate upper surface 730*a* and allow the other side of the inclined space 734 to communicate with the second outflow port 736*b*.

The valve plate lower surface 730*b* is spaced apart from the fixed end plate 510 so that the discharge valve 600 is interposed between the fixed end plate 510 and the valve plate lower surface 730*b* and the refrigerant discharged from the discharge opening 512 flows into the discharge chamber D.

The valve plate 730 may further include a first fastening hole 739*a*, which is provided in an outer peripheral portion of the valve plate 730 and penetratively formed from the valve plate upper surface 730*a* to the valve plate lower surface 730*b*, so that the first fastening hole 739*a* communicates with the second fastening hole 714 and is penetrated by the fastening bolt 770. In addition, the valve plate 730 may further include a second positioning groove 739*b* recessed from the valve plate upper surface 730*a* so that the second positioning groove 739*b* communicates with the second positioning hole 726*a* and the positioning pin 780 is inserted into the second positioning groove 739*b*.

Therefore, one end of the positioning pin 780 penetrates the first positioning hole 716 and is inserted into the first positioning groove 138*b*, and the other end of the positioning pin 780 penetrates the second positioning hole 726*a* and is inserted into the second positioning groove 739*b*, such that the cover plate 710, the injection valve 720, and the valve plate 730 of the injection valve assembly 700 may be aligned. In addition, the fastening bolt 770 penetrates the first fastening hole 739*a* and the second fastening hole 714 and is fastened to the fastening groove 138*a*, such that the injection valve assembly 700 may be fastened to the rear housing 130.

Figure 21:
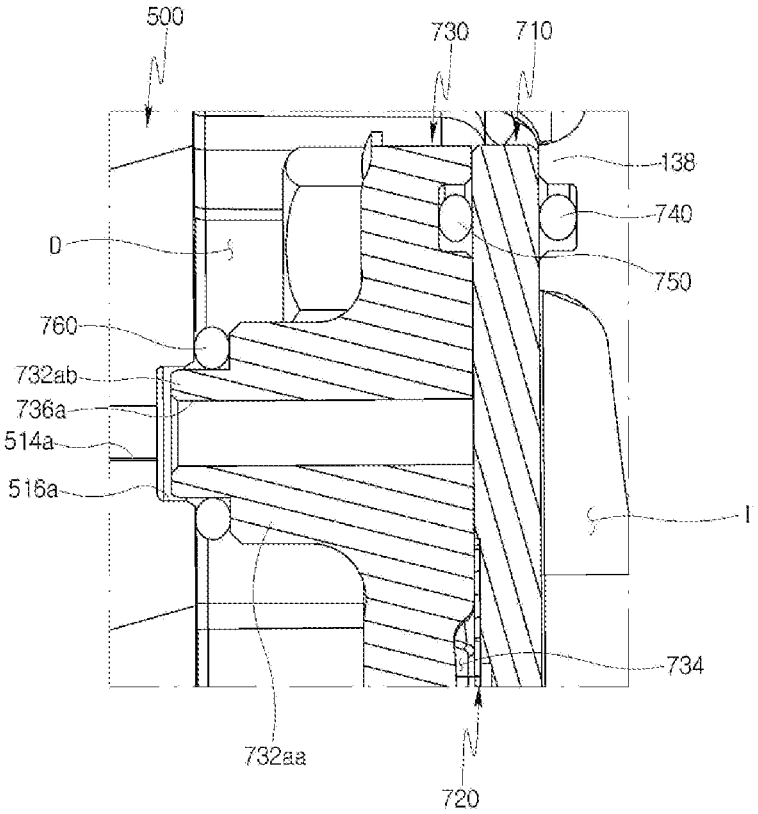
FIG. 21 is an enlarged cross-sectional view of part A in FIG. 3.
Figure 22:
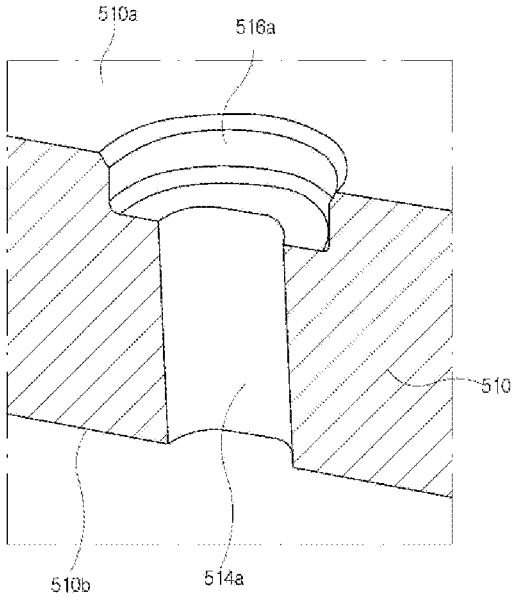
FIG. 22 is a perspective view taken along line II-II in FIG. 16.

Meanwhile, as illustrated in FIGS. 21 and 22, the fixed end plate 510 may further include a small diameter portion insertion groove 516 to prevent a leak of the refrigerant when the refrigerant flows from the injection valve assembly 700 to the first injection port 514*a* and the second injection port 514*b*. That is, the fixed end plate 510 may further include a first small diameter portion insertion groove 516*a* into which the first small diameter portion 732*ab* is inserted, and a second small diameter portion insertion groove 516*b* into which the second small diameter portion 732*bb* is inserted.

Specifically, the fixed end plate 510 may include a fixed end plate upper surface 510*a* configured to face the injection valve assembly 700, and a fixed end plate lower surface 510*b* configured to define a rear surface of the fixed end plate upper surface 510*a* and face the orbiting scroll 400.

Further, the first small diameter portion insertion groove 516*a* may be recessed from the fixed end plate upper surface 510*a* toward the fixed end plate lower surface 510*b*, and the first small diameter portion 732*ab* may be inserted into the first small diameter portion insertion groove 516*a*. The first injection port 514*a* may be recessed from the fixed end plate lower surface 510*b* toward the fixed end plate upper surface 510*a* and communicate with the first small diameter portion insertion groove 516*a*.

Likewise, the second small diameter portion insertion groove 516*b* recessed from the fixed end plate upper surface 510*a* toward the fixed end plate lower surface 510*b*, and the second small diameter portion 732*bb* may be inserted into the second small diameter portion insertion groove 516*b*. The second injection port 514*b* may be recessed from the fixed end plate lower surface 510*b* toward the fixed end plate upper surface 510*a* and communicate with the second small diameter portion insertion groove 516*b*.

In this case, as illustrated in FIG. 21, an inner diameter of the first small diameter portion 732*ab* (an inner diameter of the first outflow port 736*a*) may be equal to or larger than an inner diameter of the first injection port 514*a*, and an inner diameter of the first small diameter portion insertion groove 516*a* may be equal in level to an outer diameter of the first small diameter portion 732*ab*, such that the first small diameter portion 732*ab* may be inserted into the first small diameter portion insertion groove 516*a*, and a loss of pressure and flow rate does not occur while the refrigerant flows from the injection valve assembly 700 to the first injection port 514*a*.

An outer diameter of the first large diameter portion 732*aa* may be larger than an inner diameter of the first small diameter portion insertion groove 516*a* so that the first large diameter portion 732*aa* is not inserted into the first small diameter portion insertion groove 516*a*. In this case, a third sealing member 760 may be interposed in a compressed state between the tip surface of the first large diameter portion 732*aa* and the fixed end plate upper surface 510*a*. To this end, a protruding length of the first small diameter portion 732*ab* (an axial distance the tip surface of the first large diameter portion 732*aa* and the tip surface of the first small diameter portion 732*ab*) may be larger than a thickness of the third sealing member 760 before the deformation of the third sealing member 760 and smaller than a sum of the thickness of the third sealing member 760 before the deformation of the third sealing member 760 and an axial depth of the first small diameter portion insertion groove 516*a*.

Likewise, an inner diameter of the second small diameter portion 732*bb* (an inner diameter of the second outflow port 736*b*) may be equal to or larger than an inner diameter of the second injection port 514*b*, and an inner diameter of the second small diameter portion insertion groove 516*b* may be equal in level to an outer diameter of the second small diameter portion 732*bb* so that the second small diameter portion 732*bb* may be inserted into the second small diameter portion insertion groove 516*b*, and a loss of pressure and flow rate does not occur while the refrigerant flows from the injection valve assembly 700 to the second injection port 514*b*.

An outer diameter of the second large diameter portion 732*ba* may be larger than an inner diameter of the second small diameter portion insertion groove 516*b* so that the second large diameter portion 732*ba* is not inserted into the second small diameter portion insertion groove 516*b*. In this case, the third sealing member 760 may be interposed in a compressed state between the tip surface of the second large diameter portion 732*ba* and the fixed end plate upper surface 510*a*. To this end, a protruding length of the second small diameter portion 732*bb* (an axial distance between the tip surface of the second large diameter portion 732*ba* and the tip surface of the second small diameter portion 732*bb* may be larger than a thickness of the third sealing member 760 before the deformation of the third sealing member 760 and smaller than a sum of the thickness of the third sealing member 760 before the deformation of the third sealing member 760 and an axial depth of the second small diameter portion insertion groove 516*b*.

Meanwhile, as illustrated in FIG. 21, when the injection valve assembly 700 is fastened to the rear housing 130, a first sealing member 740 may be interposed between the cover plate upper surface 710*a* and the third annular wall 138, and a second sealing member 750 may be interposed between the valve plate upper surface 730*a* and the cover plate lower surface 710*b*.

Meanwhile, as illustrated in FIG. 18, the cover plate 710 may have a first groove 718 and a second groove 719. The first groove 718 serves to reduce a contact area between the cover plate 710 and the head portion 722 of the injection valve 720 to reduce collision noise. The first groove 718 serves to capture and discharge foreign substances to prevent the foreign substances from being trapped between the cover plate 710 and the head portion 722 of the injection valve 720. The first groove 718 may have an annular shape that is recessed from the injection valve seating groove 710*c* and surrounds the inflow port 712. The second groove 719 serves to capture and discharge foreign substances to prevent the foreign substances from being trapped between the cover plate 710 and the leg portion 724 of the injection valve 720. The second groove 719 may be recessed from the injection valve seating groove 710*c* and provided at a position facing the leg portion 724 of the injection valve 720.

Figure 16:
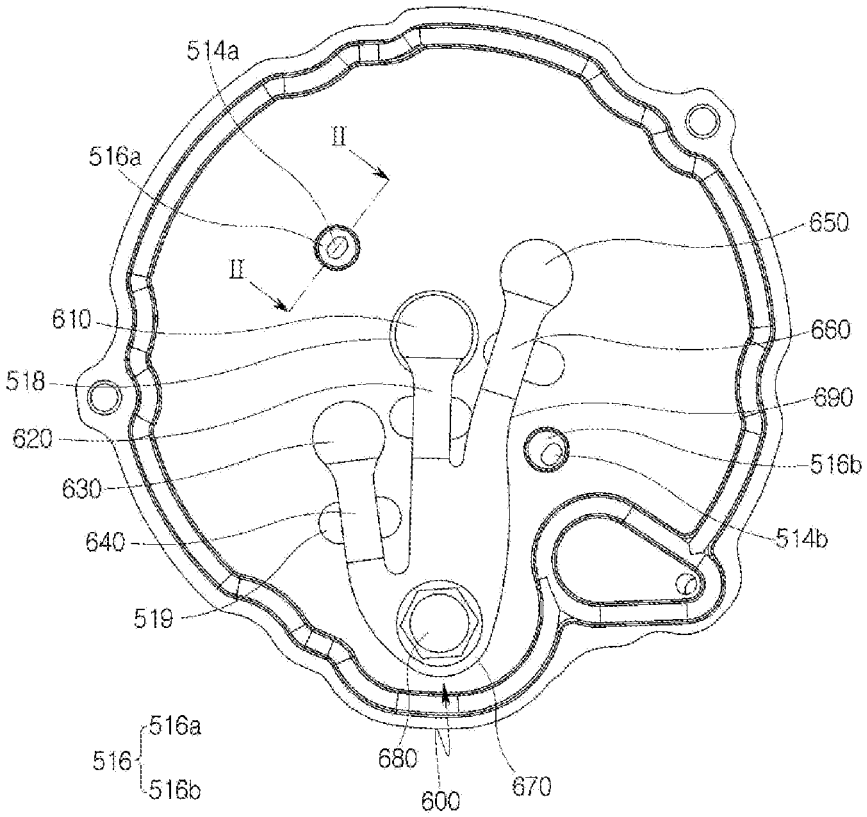
FIG. 16 is a front view of the fixed scroll mounted with a discharge valve among the components illustrated in FIG. 15.

Meanwhile, as illustrated in FIG. 16, the fixed end plate 510 may have a third groove 518 and a fourth groove 519. The third groove 518 serves to reduce a contact area between the fixed end plate 510 and the main opening/closing part 610 of the discharge valve 600 to reduce collision noise between the fixed end plate 510 and the main opening/closing part 610 of the discharge valve 600. The third groove 518 serves to capture and discharge foreign substances to prevent the foreign substances from being trapped between the fixed end plate 510 and the main opening/closing part 610 of the discharge valve 600. The third groove 518 may have an annular shape that is recessed from the fixed end plate upper surface 510*a* and surrounds the main discharge opening 512*a*. The fourth groove 519 serves to capture and discharge foreign substances to prevent the foreign substances from being trapped between the fixed end plate 510 and the main support part 620, the first sub-support part 640, and the second sub-support part 660 of the discharge valve 600. The fourth groove 519 may be recessed from the fixed end plate upper surface 510*a* and provided at a position facing the support part of the discharge valve 600.

Hereinafter, an operational effect of the scroll compressor according to the present embodiment will be described.

When power is applied to the motor 200, the rotary shaft 300 rotates together with the rotor 220, and the orbiting scroll 400 orbits by receiving a rotational force from the rotary shaft 300 through the eccentric bushing 310. Therefore, the compression chamber C moves consistently toward the center, such that a volume of the compression chamber C may be reduced.

Therefore, the refrigerant introduced into the compression chamber C may be compressed while moving toward the center along the movement route of the compression chamber C and discharged to the discharge chamber D through the discharge opening 512. The discharge-pressure refrigerant discharged to the discharge chamber D may be discharged to the outside of the compressor through the discharge port 131.

In this case, the suction-pressure refrigerant may flow into the compression chamber C through the suction port (not illustrated), the motor accommodation space S1, the suction flow path (not illustrated), and the scroll accommodation space S2.

In addition, the scroll compressor according to the present embodiment includes the injection flow path (the introduction port 133, the introduction chamber I, the injection valve assembly 700, the communication port 612, and the injection port 514) configured to guide the middle-pressure refrigerant to the compression chamber C. Therefore, the scroll compressor may compress and discharge the middle-pressure refrigerant as well as the suction-pressure refrigerant, such that the discharge flow rate of the refrigerant may be further increased than a case in which only the suction-pressure refrigerant is introduced, compressed, and discharged. Therefore, the performance and efficiency of the compressor may be improved.

In addition, the rear housing 130 includes the introduction port 133 and the introduction chamber I as well as the discharge chamber D and the discharge port 131. That is, the rear housing 130 having the discharge chamber D, the discharge port 131, the introduction port 133, and the introduction chamber I is integrally formed, such that the likelihood of the refrigerant is reduced, and the size, costs and weight may be reduced.

In addition, since at least a part of the introduction chamber I is accommodated in the discharge chamber D, the refrigerant guided to the injection port 514 may exchange heat with the refrigerant in the discharge chamber D through the third annular wall 138 and the injection valve assembly 700. That is, the refrigerant in the introduction chamber I and the refrigerant passing through the injection valve assembly 700 may be heated by receiving heat from the refrigerant in the discharge chamber D. Therefore, it is possible to prevent the liquid refrigerant from being injected into the compression chamber C through the injection port 514.

In addition, the position of the edge, which defines the minor axis of the first injection port 514*a* or the second injection port 514*b*, is restricted to seal the first injection port 514*a* or the second injection port 514*b* and prevent the first injection port 514*a* or the second injection port 514*b* from communicating with the second inner compression chamber C22 and the first outer compression chamber C11 through the chamfer 421 of the orbiting wrap when the orbiting wrap 420 of the orbiting scroll faces the first and second injection ports 514*a* and 514*b*. Therefore, it is possible to prevent the internal leak through the first and second injection ports 514*a* and 514*b* and improve the performance and durability of the compressor. That is, when the first and second injection ports 514*a* and 514*b* face the orbiting wrap 420, the second inner compression chamber C22 and the first outer compression chamber C11, which are adjacent to the first and second injection ports 514*a* and 514*b*, are not in fluid communication with each other through the injection flow path of the injection valve assembly 700.

Next, a scroll compressor according to a second embodiment of the present disclosure will be described with reference to FIGS. 23 to 34. The configurations of the center housing, the front housing, the motor, the rotary shaft, and the orbiting scroll of the scroll compressor according to the first embodiment are identical to those of the scroll compressor according to the second embodiment of the present disclosure, and the scroll compressor according to the second embodiment differs from the scroll compressor according to the first embodiment in terms of the shape of the rear housing and the shapes of the fixed scroll and the injection valve assembly disposed in the rear housing. Therefore, the description will be made focusing on the differences.

As illustrated in FIGS. 23 to 26, as in above-mentioned the description, a rear housing 1130 according to the present embodiment includes a rear end plate 1132, and a first annular wall 1134, a second annular wall 1136, and a third annular wall 1138 that protrude from the rear end plate 1132. The first annular wall 1134, the second annular wall 1136, and the third annular wall 1138 have different heights. In this case, the first annular wall 1134 defines a scroll accommodation space S2', and the second annular wall 1136 has an annular shape having a smaller diameter than the first annular wall 1134. The second annular wall 1136 comes into contact with an outer peripheral portion of a fixed end plate 1510 of a fixed scroll 1500 to be described below, thereby defining a discharge chamber D' that accommodates a refrigerant discharged from a compression chamber. In addition, the third annular wall 1138 has an annular shape having a smaller diameter than the second annular wall 1136 and is covered by a cover plate 1710 of an injection valve assembly 1700 to be described below, thereby defining an introduction chamber I' that accommodates the refrigerant introduced through an introduction port 1133.

The rear end plate 1132 has a discharge port 1131 and the introduction port 1133. The discharge port 1131 guides the refrigerant in the discharge chamber D' to the outside of the housing. The introduction port 1133 communicates with the introduction chamber I', and the middle-pressure refrigerant introduced into the introduction port 1133 from the outside of the housing. Further, the third annular wall 1138 may have fastening grooves 1138*a* into which fastening bolts 1770 are inserted, and first positioning grooves 1138*b* into which positioning pins 1780 are inserted.

Figure 23:
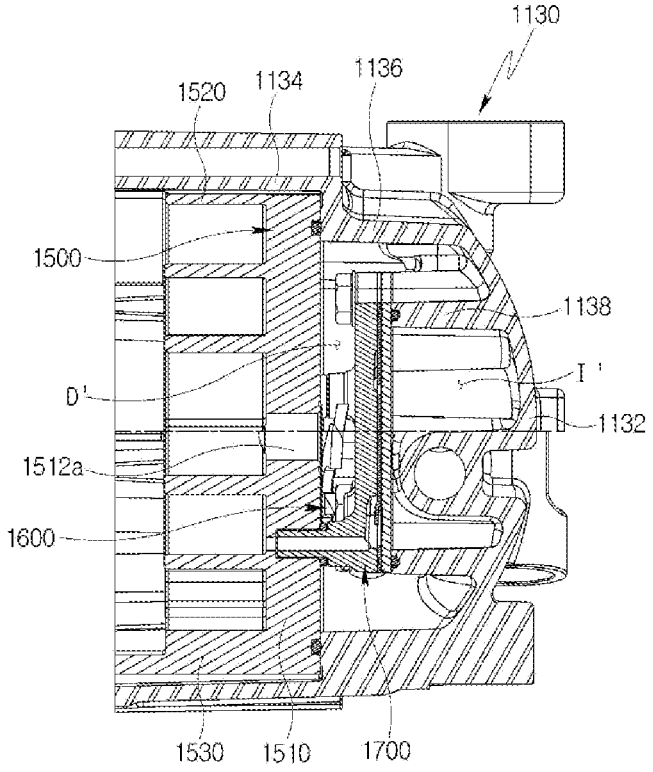
FIG. 23 is a cross-sectional view illustrating a rear housing of a scroll compressor according to another embodiment of the present disclosure.
Figure 24:
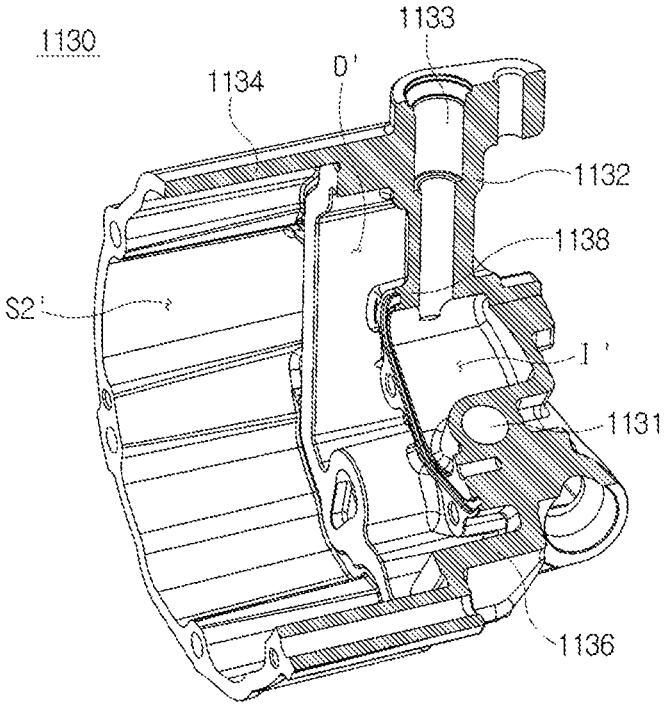
FIG. 24 is a partially cross-sectional perspective view illustrating a state in which the rear housing is separated from the scroll compressor illustrated in FIG. 23.
Figure 25:
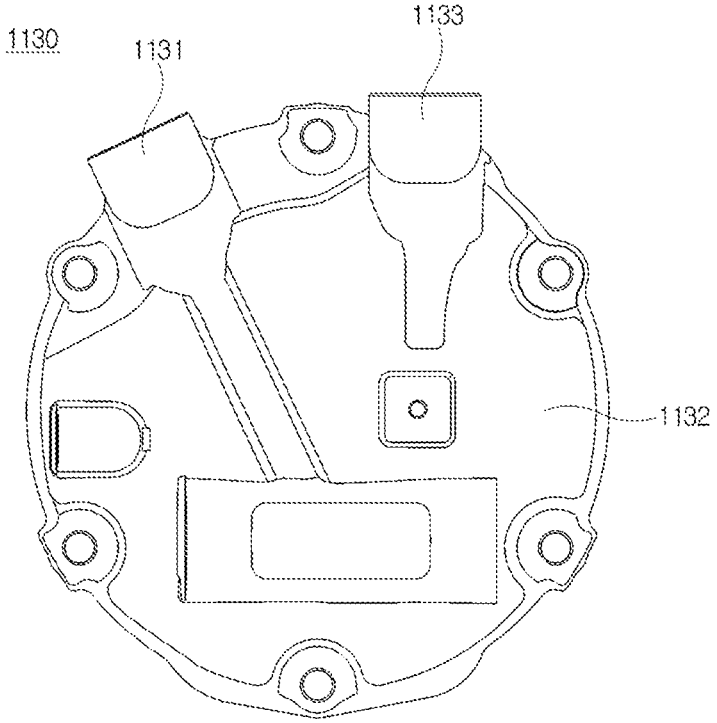
FIG. 25 is a front view illustrating a state in which the rear housing is separated from the scroll compressor illustrated in FIG. 23.
Figure 26:
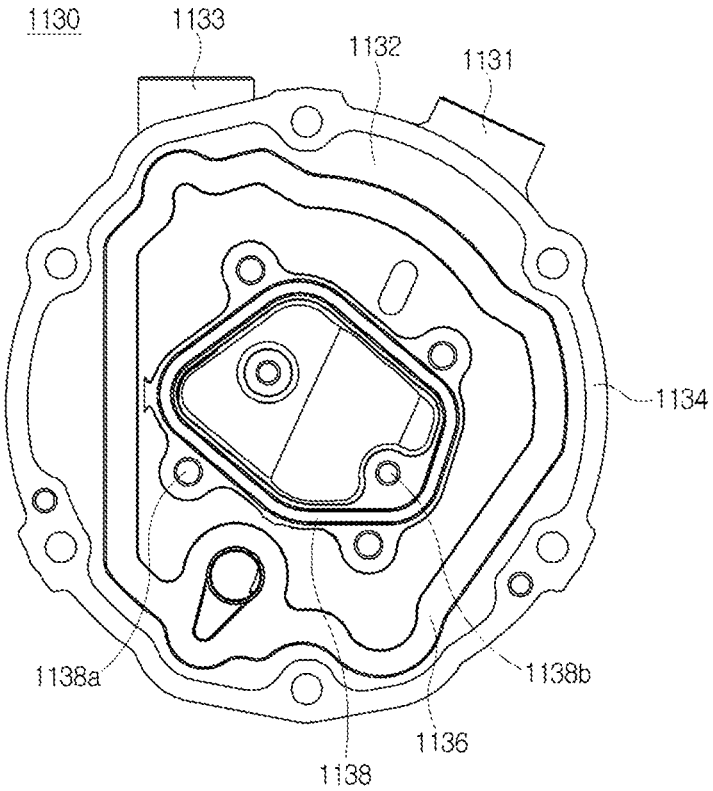
FIG. 26 is a rear view of FIG. 25.
Figure 27:
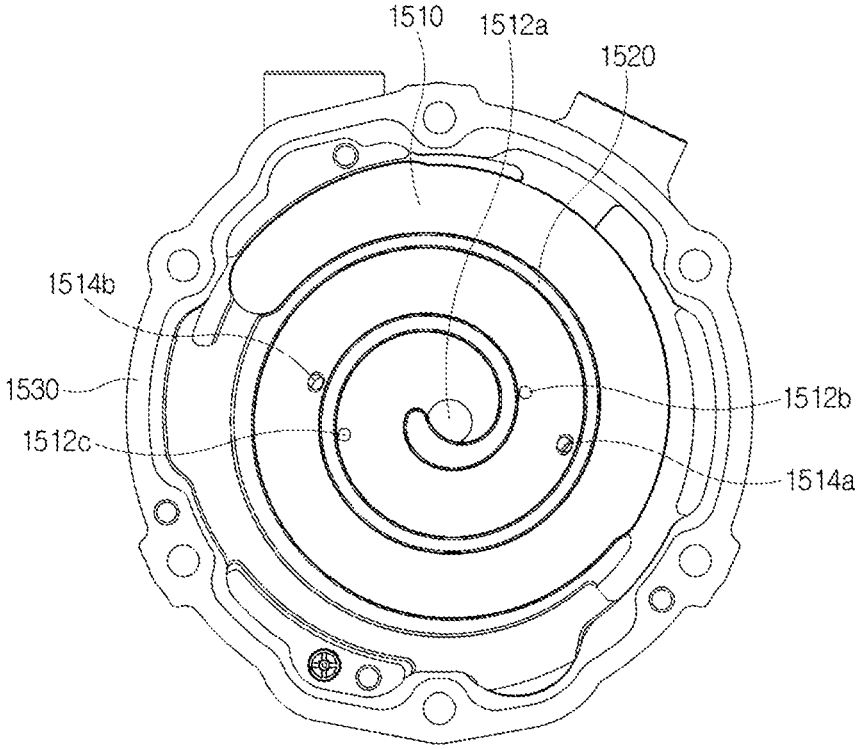
FIG. 27 is a rear view of a fixed scroll of the scroll compressor illustrated in FIG. 23.
Figure 28:
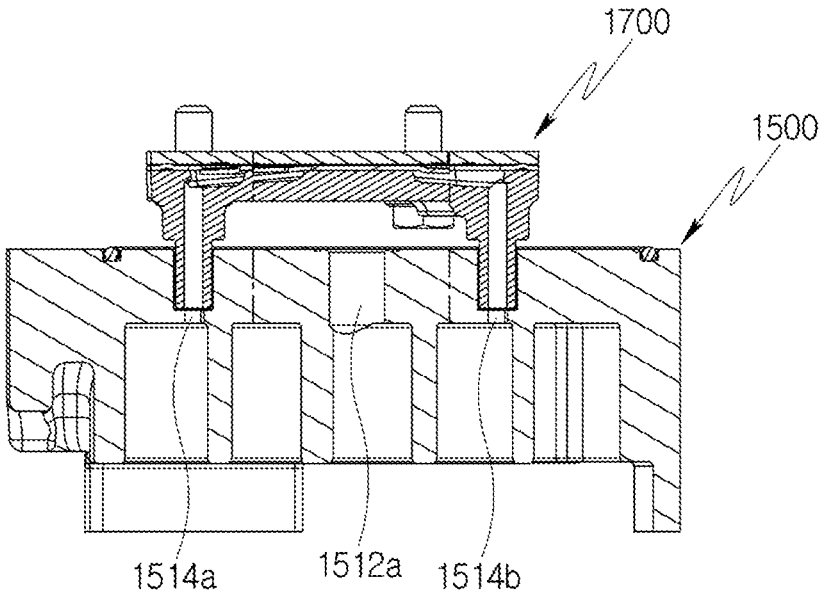
FIG. 28 is a cross-sectional view illustrating the fixed scroll and an injection valve assembly illustrated in FIG. 23 when viewed in another direction.

As illustrated in FIGS. 23, 27 and 28, as in the above-mentioned description, the fixed scroll 1500 according to the present embodiment includes: the fixed end plate 1510 having a circular plate shape; a fixed wrap 1520 protruding from a central portion of the fixed end plate 1510 and configured to engage with an orbiting wrap of the orbiting scroll; and a fixed side plate 1530 protruding from an outer peripheral portion of the fixed end plate 1510 and fastened to a center end plate of a center housing.

The fixed end plate 1510 includes: a discharge opening 1512 from which the refrigerant in the compression chamber is discharged to the discharge chamber D'; and an injection port 1514 configured to guide the refrigerant, discharged from the injection valve assembly 1700, to the compression chamber. The discharge opening 1512 may be provided in plural, and the plurality of discharge openings 1512 may be opened or closed by a discharge valve 1600 interposed between the fixed end plate 1510 and the injection valve assembly 1700. The plurality of discharge openings 1512 includes a main discharge opening 1512*a*, a first sub-discharge opening 1512*b*, and a second sub-discharge opening 1512*c*. The injection port 1514 may also be provided in plural, and the plurality of injection ports 1514 includes a first injection port 1514*a* and a second injection port 1514*b*.

As described above, in the present embodiment, the first and second injection ports 1514*a* and 1514*b* are formed are formed so as to prevent the internal leak at the moment when the first and second injection ports 1514*a* and 1514*b* overlap the orbiting wrap of the orbiting scroll.

Figure 29:
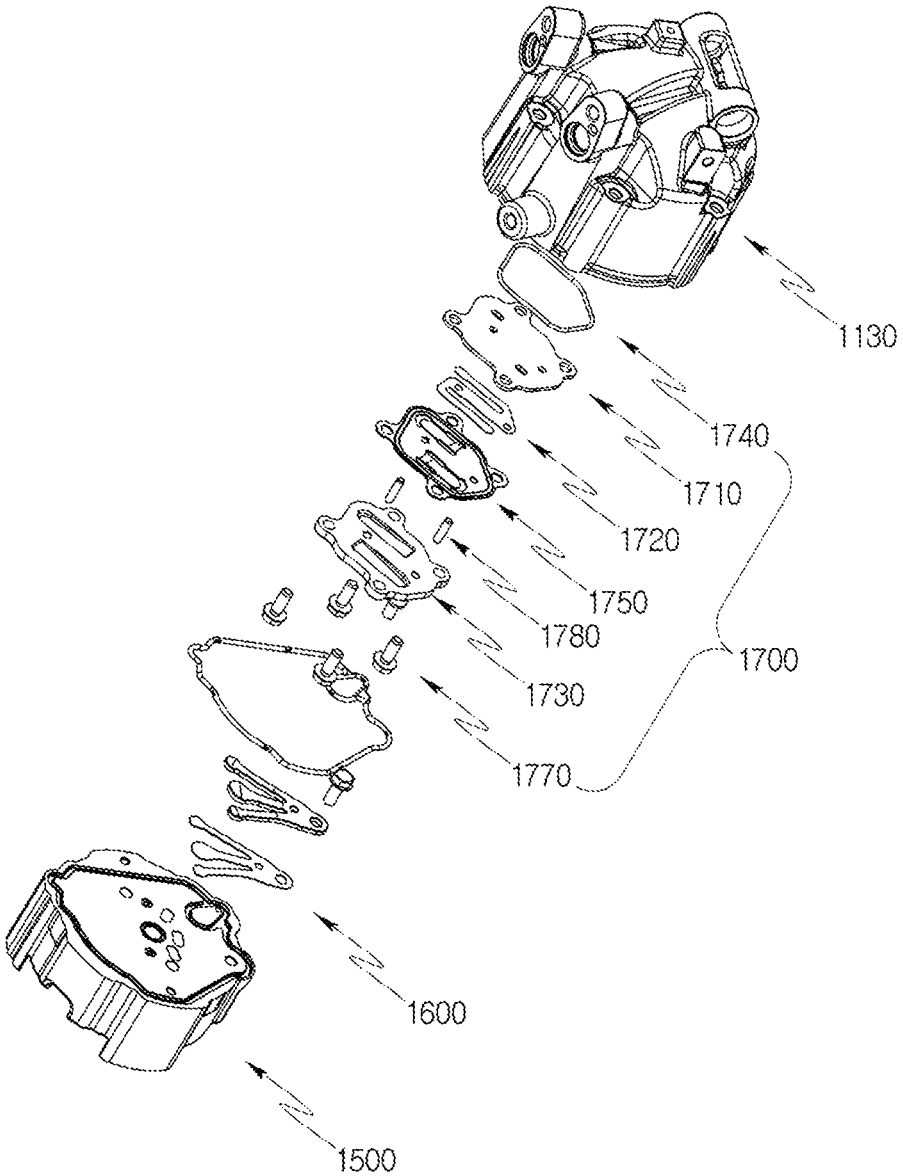
FIG. 29 is an exploded perspective view illustrating the rear housing illustrated in FIG. 23 and components accommodated in the rear housing.
Figure 30:
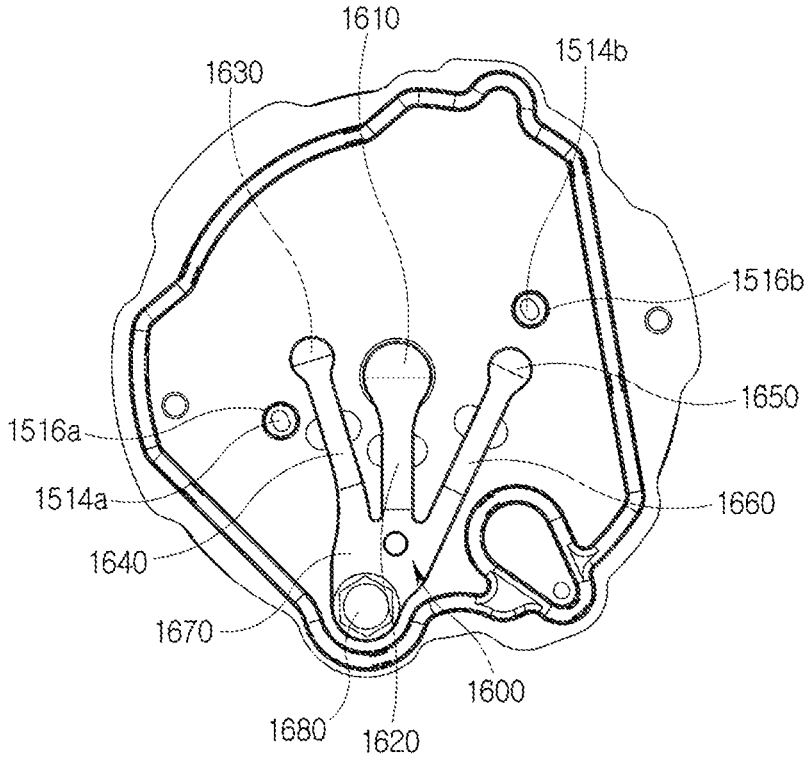
FIG. 30 is a front view of the fixed scroll mounted with a discharge valve among the components illustrated in FIG. 29.

Next, the discharge valve 1600 will be described with reference to FIGS. 29 and 30. As in the above-mentioned description, the discharge valve 1600 includes a main opening/closing part 1610 configured to open or close the main discharge opening 1512*a*, a first sub-opening/closing part 1630 configured to open or close the first sub-discharge opening 1512*b*, a second sub-opening/closing part 1650 configured to open or close the second sub-discharge opening 1512*c*, a fastening part 1670 fastened to the fixed end plate 1510, a main support part 1620 extending from the main opening/closing part 1610 to the fastening part 1670, a first sub-support part 1640 extending from the first sub-opening/closing part 1630 to the fastening part 1670, and a second sub-support part 1660 extending from the second sub-opening/closing part 1650 to the fastening part 1670. The fastening part 1670 may be fastened to the fixed end plate 1510 by means of a single fastening member 1680.

Next, the injection valve assembly 1700 will be described with reference to FIGS. 29 and 31 to 34. In the present embodiment, the injection valve assembly 1700 may include an anti-leakage means together with an injection valve for opening or closing an injection flow path, thereby preventing a leakage of the refrigerant through the injection valve assembly.

Specifically, the injection valve assembly 1700 may include: the cover plate 1710 fastened to a tip surface of the third annular wall 1138 and configured to cover the introduction chamber I'; a valve plate 1730 fastened to the cover plate 1710 and disposed opposite to the introduction chamber I' based on the cover plate 1710; a gasket retainer 1750 interposed, as an anti-leakage means, between the cover plate 1710 and the valve plate 1730; and an injection valve 1720 interposed between the cover plate 1710 and the gasket retainer 1750.

Figure 31:
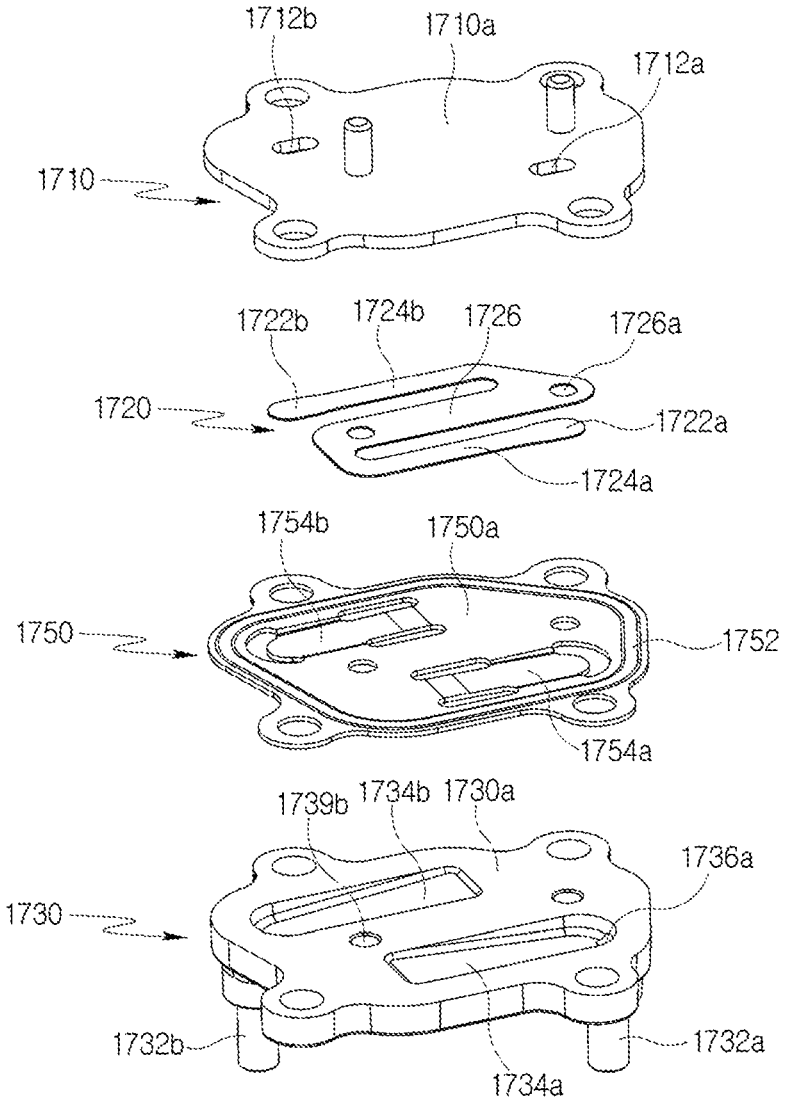
FIG. 31 is an exploded perspective view illustrating an injection valve assembly among the components illustrated in FIG. 29.
Figure 32:
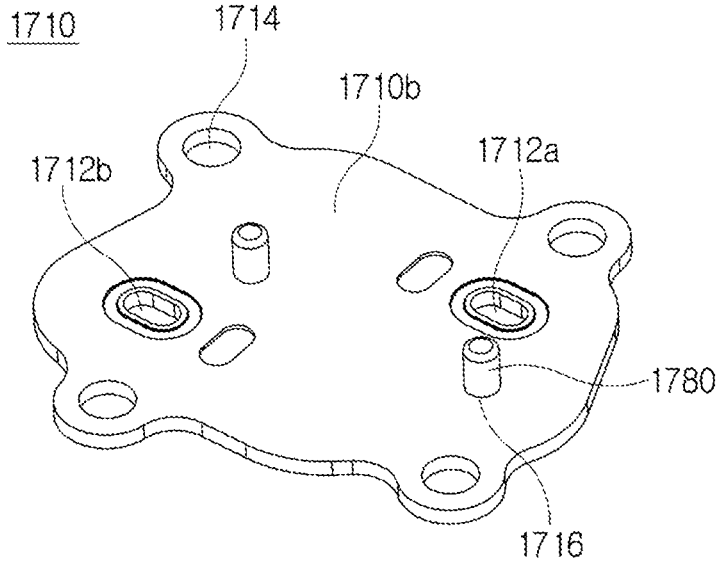
FIG. 32 is a perspective view illustrating a rear surface of a cover plate of the injection valve assembly illustrated in FIG. 31.

As illustrated in FIGS. 31 and 32, the cover plate 1710 includes a cover plate upper surface 1710*a* facing the third annular wall 1138, and a cover plate lower surface 1710*b* facing the gasket retainer 1750. In addition, the cover plate 1710 further includes: inflow ports 1712 configured to allow the introduction chamber I' and inclined spaces 1734 to be described below to communicate with each other; the second fastening holes 1714 communicating with the fastening grooves 1138*a* and penetrated by the fastening bolts 1770; and first positioning holes 1716 communicating with the first positioning grooves 1138*b* and penetrated by the positioning pins 1780.

The inflow ports 1712 are penetratively formed from the cover plate upper surface 1710*a* to the cover plate lower surface 1710*b*. In the present embodiment, the inflow ports 1712 include a first inflow port 1712*a* communicating with one side of the introduction chamber I', and a second inflow port 1712*b* formed independently of the first inflow port 1712*a* and communicating with the other side of the introduction chamber I'. In this case, the first and second inflow ports 1712*a* and 1712*b* may each be provided in the form of a long hole to maximize a valve lifting force and an inflow flow rate of the refrigerant. Meanwhile, a first sealing member 1740 is interposed between the cover plate upper surface 710*a* and the third annular wall 138 when the injection valve assembly 700 is fastened to the rear housing 130.

As illustrated in FIG. 31, the injection valve 1720 may include: a first head portion 1722*a* configured to open or close the first inflow port 1712*a;* a first leg portion 1724*a* configured to support the first head portion 1722*a;* a second head portion 1722*b* configured to open or close the second inflow port 1712*b;* a second leg portion 1724*b* configured to support the second head portion 1722*b;* and a connection portion 1726 configured to connect the first leg portion 1724*a* and the second leg portion 1724*b*. The first and second leg portions 1724*a* and 1724*b* are formed in parallel with each other. A connected portion between the first leg portion 1724*a* and the connection portion 1726 may be formed opposite to a connected portion between the second leg portion 1724*b* and the connection portion 1726 to implement the compact structure. In addition, the connection portion 1726 includes second positioning holes 1726*a* communicating with the first positioning holes 1716 and penetrated by the positioning pins 1780.

In this case, the injection valve 1720 is fixed by being compressed between the cover plate 1710 and the gasket retainer 1750 without a separate fastening member for fixing the injection valve 1720. This configuration will be described below in more detail.

Figure 33:
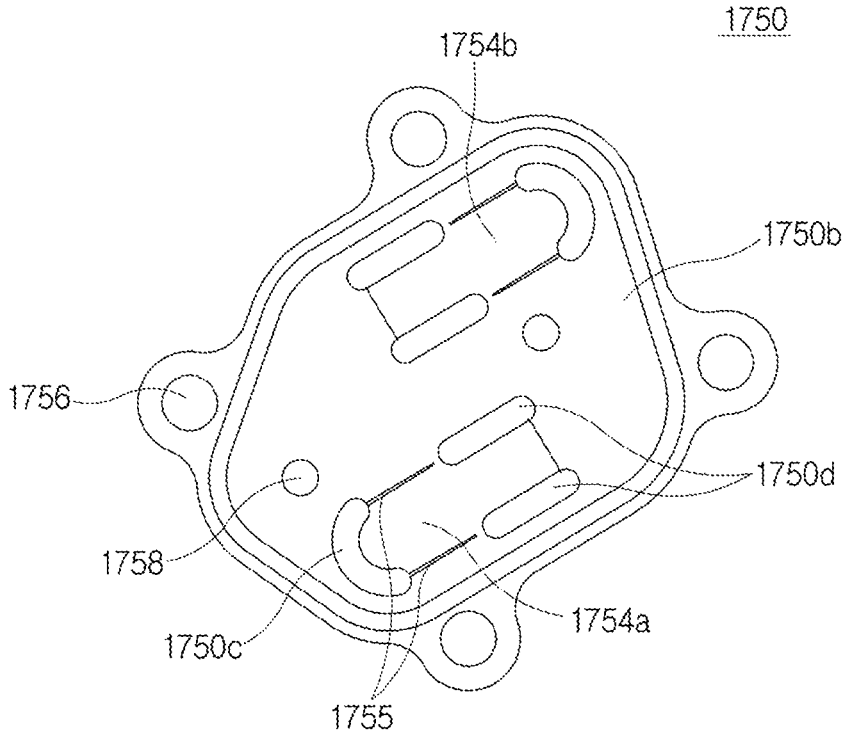
FIG. 33 is a rear view of a gasket retainer of the injection valve assembly illustrated in FIG. 31.

As illustrated in FIGS. 31 and 33, the gasket retainer 1750 includes a gasket retainer upper surface 1750*a* facing the cover plate 1710 and the injection valve 1720, and a gasket retainer lower surface 1750*b* facing the valve plate 1730. Further, the gasket retainer 1750 further includes a bead portion 1752 protruding along a periphery of the gasket retainer upper surface 1750*a,* and retainer portions 1754 each serving as a retainer for the injection valve 1720 and inclinedly formed on the gasket retainer 1750. In this case, the retainer portion 1754 is formed to be inclined in a direction in which the injection valve 1720 is opened, i.e., a direction toward the valve plate 1730.

The retainer portions 1754 may serve to support the head portions 1722 and the leg portions 1724 of the injection valve 1720 when the injection valve 1720 opens the inflow ports 1712 and restrict the positions at which the injection valve 1720 is maximally opened in accordance with the inclination of the retainer portions 1754. To this end, the retainer portions 1754 include a first retainer portion 1754*a* configured to support the first head portion 1722*a* and the first leg portion 1724*a,* and a second retainer portion 1754*b* configured to support the second head portion 1722*b* and the second leg portion 1724*b*. In this case, the first and second retainer portions 1754*a* and 1754*b* may be inclined in a staggered manner to correspond to the first and second leg portions 1724*a* and 1724*b*.

The first and second retainer portions 1754*a* and 1754*b* are inclinedly formed by means of cut-out portions formed in the gasket retainer 1750. Specifically, in the present embodiment, the cut-out portion has a 'U' shape, an inner portion, which is cut by the cut-out portion in a body of the gasket retainer 1750, is inclinedly formed as the retainer portion 1754. In this case, a pair of blade portions 1755 is provided at two opposite sides of the retainer portion 1754 and connects the two opposite sides of the retainer portion 1754 to the body of the gasket retainer 1750 facing the two opposite sides of the retainer portion 1754 in order to maintain an inclination angle of the retainer portion. Therefore, a main flow hole 1750*c* having a 'U' shape may be formed at one side of the pair of blade portions 1755, and a pair of auxiliary flow holes 1750*d* may be formed at the other side of the pair of blade portions 1755. Therefore, when the injection valve 1720 is opened, the refrigerant introduced into the inflow port 1712 of the cover plate may flow to the inclined spaces 1734 of the valve plate through the main flow hole 1750*c* and the pair of auxiliary flow holes 1750*d*.

Further, the gasket retainer 1750 may further include: third fastening holes 1756 communicating with the second fastening holes 1714 and penetrated by the fastening bolts 1770; and third positioning holes 1758 communicating with the second positioning hole 1726*a* and penetrated by the positioning pins 1780.

The gasket retainer 1750 is compressed between the cover plate 1710 and the valve plate 1730. Therefore, the injection valve 1720 may be fixed in position between the cover plate 1710 and the gasket retainer 1750 by being compressed, and at the same time, the gasket retainer 1750 may seal a portion between the cover plate 1710 and the valve plate 1730. In particular, when the gasket retainer 1750 is compressed between the cover plate 1710 and the valve plate 1730, the bead portion 1752 may seal the periphery of the injection valve 1720 against the cover plate 1710. To this end, a height by which the bead portion 1752 protrudes may be equal to or larger than a thickness of the injection valve 1720.

Figure 34:
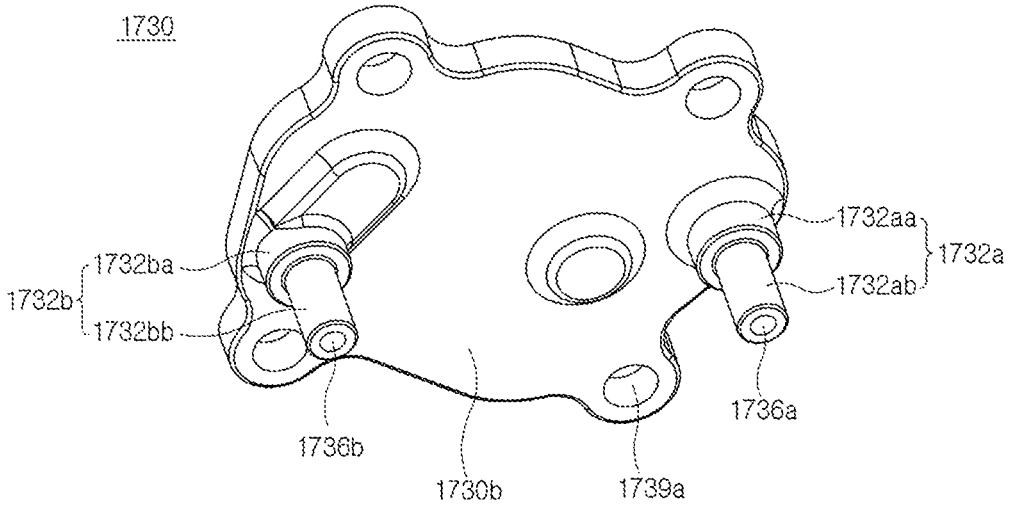
FIG. 34 is a perspective view illustrating a rear surface of a valve plate of the injection valve assembly illustrated in FIG. 31.

As illustrated in FIGS. 31 and 34, the valve plate 1730 includes a valve plate upper surface 1730*a* facing the gasket retainer 1750, and a valve plate lower surface 1730*b* facing the fixed scroll 1500. In addition, the valve plate 1730 further includes protruding portions 1732 protruding from the valve plate lower surface 1730*b* toward the first and second injection ports 1514*a* and 1514*b*. That is, the valve plate 1730 includes a first protruding portion 1732*a* protruding from one side of the valve plate lower surface 1730*b* toward the first injection port 1514*a,* and a second protruding portion 1732*b* protruding from the other side of the valve plate lower surface 1730*b* toward the second injection port 1514*b*.

In this case, the first protruding portion 1732*a* includes a first large diameter portion 1732*aa* protruding from one side of the valve plate lower surface 1730*b* toward the first injection port 1514*a*, and a first small diameter portion 1732*ab* further protruding from the first large diameter portion 1732*aa* toward the first injection port 1514*a*. Likewise, the second protruding portion 1732*b* also includes a second large diameter portion 1732*ba* protruding from the other side of the valve plate lower surface 1730*b* toward the second injection port 1514*b*, and a second small diameter portion 1732*bb* further protruding from the second large diameter portion 1732*ba* toward the second injection port 1514*b*. Therefore, as illustrated in FIG. 30, the fixed end plate 1510 includes: a first small diameter portion insertion groove 1516*a* into which the first small diameter portion 1732*ab* is inserted, and a second small diameter portion insertion groove 1516*b* into which the second small diameter portion 1732*bb* is inserted.

In addition, the valve plate 1730 further includes: a first inclined space 1734*a* configured to accommodate the refrigerant introduced through the first inflow port 1712*a;* a second inclined space 1734*b* configured to accommodate the refrigerant introduced through the second inflow port 1712*b;* a first outflow port 1736*a* formed in the first protruding portion 1732*a* and configured to guide the refrigerant in the first inclined space 1734*a* to the first injection port 1514*a;* and a second outflow port 1736*b* formed in the second protruding portion 1732*b* and configured to guide the refrigerant in the second inclined space 1734*b* to the second injection port 1514*b*. The first and second inclined spaces 1734*a* and 1734*b* are recessed from the valve plate upper surface 1730*a* and separated from each other. In addition, the first and second inclined spaces 1734*a* and 1734*b* may be formed to be inclined in a staggered manner so that the first and second retainer portions 1754*a* and 1754*b* may be respectively seated.

Further, the valve plate 1730 may further include first fastening holes 1739*a* communicating with the third fastening holes 1756 and penetrated by the fastening bolts 1770, and second positioning grooves 1739*b* communicating with the third positioning holes 1758 and recessed from the valve plate upper surface 1730*a* so that the positioning pins 1780 are inserted into the second positioning grooves 1739*b*.

The operational effect of the scroll compressor according to the present embodiment is identical to the operational effect of the scroll compressor according to the above-mentioned embodiment.

The present disclosure is not limited to the specific exemplary embodiments and descriptions, various modifications can be made by any person skilled in the art to which the present disclosure pertains without departing from the subject matter of the present disclosure as claimed in the claims, and the modifications are within the scope defined by the claims.

DESCRIPTION OF REFERENCE NUMERALS

100: Housing
110: Center housing
112: Center end plate
112*a:* Bearing hole
112*b:* Backpressure chamber
114: Center side plate
120: Front housing
122: Front end plate
124: Front side plate
130, 1130: Rear housing
131, 1131: Discharge port
132, 1132: Rear end plate
133, 1133: Introduction port
134, 1134: First annular wall
136, 1136: Second annular wall
138, 1138: Third annular wall
138*a*, 1138*a:* Fastening groove
138*b*, 1138*b:* First positioning groove
200: Motor
210: Stator
220: Rotor
300: Rotary shaft
310: Eccentric bushing
400: Orbiting scroll
410: Orbiting end plate
420: Orbiting wrap
421: Chamfer
422: Planar portion
430: Boss part
500, 1500: Fixed scroll
510, 1510: Fixed end plate
512, 1512: Discharge opening
514, 1514: Injection port
520, 1520: Fixed wrap
530, 1530: Fixed side plate
532: Fixed wrap introduction part
600, 1600: Discharge valve
610, 1610: Main opening/closing part
620, 1620: Main support part
630, 1630: First sub-opening/closing part
640, 1640: First sub-support part
650, 1650: Second sub-opening/closing part
660, 1660: Second sub-support part
670, 1670: Fastening part
680, 1680: Fastening member
690: Avoidance part
700, 1700: Injection valve assembly
710, 1710: Cover plate
712, 1712: Inflow port
714, 1714: Second fastening hole
716, 1716: First positioning hole
718: First groove
719: Second groove
720, 1720: Injection valve
722, 1722: Head portion
724, 1724: Leg portion
726: Peripheral portion
1726: Connection portion
726*a*, 1726*a:* Second positioning hole
730, 1730: Valve plate
732, 1732: Protruding portion
734, 1734: Inclined space
736, 1736: Outflow port
738: Connection flow path
739*a*, 1739*a:* First fastening hole
739*b*, 1739*b:* Second positioning groove
740, 1740: First sealing member
750: Second sealing member
1750: Gasket retainer
1750*c:* Main flow hole
1750*d:* Auxiliary flow hole
1752: Bead portion
1754: Retainer portion
1755: Blade portion
1756: Third fastening hole
1758: Third positioning hole
760: Third sealing member

770, 1770: Fastening bolt
780, 1780: Positioning pin
C: Compression chamber
D, D': Discharge chamber
I, I': Introduction chamber

What is claimed is:

1. A scroll compressor comprising:
a housing;
a motor provided in the housing;
a rotary shaft configured to be rotated by the motor;
an orbiting scroll configured to orbit in conjunction with the rotary shaft; and
a fixed scroll configured to define a plurality compression chambers together with the orbiting scroll,
wherein the housing comprises:
a center housing penetrated by the rotary shaft;
a front housing configured to define a motor accommodation space that accommodates the motor; and
a rear housing configured to define a discharge chamber for accommodating a refrigerant discharged from the plurality of compression chambers, and an introduction chamber for accommodating a middle-pressure refrigerant introduced from an outside of the housing, wherein the fixed scroll has a plurality of injection ports that guides the refrigerant in the introduction chamber to the plurality compression chambers, and wherein when the plurality of injection ports faces an orbiting wrap of the orbiting scroll, at least one of the plurality of injection ports is closed by the orbiting wrap of the orbiting scroll so as not to communicate with the plurality of compression chambers, wherein the plurality of injection ports comprises:
a first injection port of the plurality of injection ports disposed adjacent to an inner peripheral surface of a fixed wrap of the fixed scroll so as to communicate with a first outer compression chamber of the plurality of compression chambers defined by an outer peripheral surface of the orbiting wrap of the orbiting scroll and the inner peripheral surface of the fixed wrap of the fixed scroll; and
a second injection port of the plurality of injection ports disposed adjacent to an outer peripheral surface of the fixed wrap so as to communicate with a first inner compression chamber of the plurality of compression chambers defined by an inner peripheral surface of the orbiting wrap of the orbiting scroll and the outer peripheral surface of the fixed wrap of the fixed scroll, wherein the first injection port and the second injection port each have a long hole shape, and a length of a minor axis of a first one of the first injection port and the second injection port is shorter than a length of a minor axis of a second one of the first injection port and the second injection port.

2. The scroll compressor of claim 1, wherein when the plurality of injection ports faces the orbiting wrap of the orbiting scroll, a pressure of the refrigerant in a first one of the plurality of compression chambers adjacent to the first injection port is higher than a pressure of the refrigerant in a second one of the plurality of compression chambers adjacent to the second injection port.

3. The scroll compressor of claim 2, wherein the plurality of compression chambers comprise:
a pair of first compression chambers having the refrigerant at a first pressure in a first pressure range;
a pair of second compression chambers positioned to be closer to a centripetal side in a radial direction than the pair of first compression chambers to the centripetal side and having the refrigerant at a second pressure in a second pressure range higher than the first pressure range; and
a third compression chamber positioned to be closer to the centripetal side in the radial direction than the pair of second compression chambers to the centripetal side and having the refrigerant at a third pressure in a third pressure range higher than the second pressure range,
wherein the pair of first compression chambers comprises:
the first outer compression chamber defined by the outer peripheral surface of the orbiting wrap and the inner peripheral surface of the fixed wrap; and
the first inner compression chamber defined by the inner peripheral surface of the orbiting wrap and the outer peripheral surface of the fixed wrap,
wherein the pair of second compression chambers comprises:
a second outer compression chamber defined by the outer peripheral surface of the orbiting wrap and the inner peripheral surface of the fixed wrap; and
a second inner compression chamber defined by the inner peripheral surface of the orbiting wrap and the outer peripheral surface of the fixed wrap, and
wherein the first injection port is capable of communicating with the first outer compression chamber, and the second injection port is capable of communicating with the second inner compression chamber.

4. The scroll compressor of claim 3, wherein when the plurality of injection ports faces the orbiting wrap of the orbiting scroll, the first injection port is disposed adjacent to the second inner compression chamber, and the second injection port is disposed adjacent to the first outer compression chamber.

5. The scroll compressor of claim 1, wherein a length of a major axis of the first injection port and a length of a major axis of the second injection port are equal to each other.

6. The scroll compressor of claim 1, wherein an end of the orbiting wrap comprises a planar portion and a pair of chamfers disposed at two opposite sides of the planar portion.

7. The scroll compressor of claim 6, wherein when the orbiting wrap faces the first injection port and the second injection port, a radial outer edge, which defines the minor axis of the second injection port, is positioned to be in contact with the planar portion of the orbiting wrap.

8. The scroll compressor of claim 7, wherein a length of the minor axis of the second injection port is equal to or shorter than a length of the planar portion of the orbiting wrap.

9. The scroll compressor of claim 6, wherein when the orbiting wrap faces the first and second injection ports, a radial inner edge, which defines the minor axis of the first injection port, is positioned to be in contact with the planar portion of the orbiting wrap.

10. The scroll compressor of claim 9, wherein a length of the minor axis of the first injection port is equal to or shorter than a length of the planar portion of the orbiting wrap.

11. The scroll compressor of claim 1, wherein an injection valve assembly is provided between the fixed scroll and the rear housing and opens or closes an injection flow path that guides the middle-pressure refrigerant from the introduction chamber to the plurality of injection ports.

12. The scroll compressor of claim 11, wherein when the plurality of injection ports faces the orbiting wrap, the compression chambers adjacent to the plurality of injection ports are not in fluid communication with each other through the injection flow path of the injection valve assembly.

13. The scroll compressor of claim 12, wherein the injection valve assembly comprises:

a cover plate coupled to the rear housing and having one or more inflow ports into which the refrigerant in the introduction chamber is introduced;

a valve plate coupled to the cover plate and having one or more inclined spaces which accommodate the refrigerant introduced throught the one or more inflow ports, and a plurality of outflow ports through which the refrigerant in the one more inclined spaces is discharged to the plurality of injection ports; and an injection valve interposed between the cover plate and the valve plate.

14. The scroll compressor of claim 13, wherein the injection valve assembly further comprises a gasket retainer interposed between the cover plate and the valve plate and having one or more retainer portions inclinedly formed to allow the one or more inflow ports and the one or more inclined spaces to communicate with each other, and wherein the injection valve is interposed between the cover plate and the gasket retainer, and the gasket retainer and the injection valve are compressed between the cover plate and the valve plate.

* * * * *